US010116090B2

(12) United States Patent
Iwamoto

(10) Patent No.: US 10,116,090 B2
(45) Date of Patent: Oct. 30, 2018

(54) FEMALE CONNECTOR AND CONNECTION STRUCTURE OF FEMALE CONNECTOR AND MALE CONNECTOR

(71) Applicant: HOSIDEN CORPORATION, Yao-shi, Osaka (JP)

(72) Inventor: Yuta Iwamoto, Yao (JP)

(73) Assignee: HOSIDEN CORPORATION, Yao-shi, Osaka (JP)

( * ) Notice: Subject to any disclaimer, the term of this patent is extended or adjusted under 35 U.S.C. 154(b) by 0 days.

(21) Appl. No.: 15/913,239

(22) Filed: Mar. 6, 2018

(65) Prior Publication Data

US 2018/0269625 A1 Sep. 20, 2018

(30) Foreign Application Priority Data

Mar. 17, 2017 (JP) ..... 2017-053096
May 18, 2017 (JP) ..... 2017-098871

(51) Int. Cl.

| | |
|---|---|
| ***H01R 13/627*** | (2006.01) |
| ***H01R 13/502*** | (2006.01) |
| *H01R 13/64* | (2006.01) |
| *H01R 13/629* | (2006.01) |
| *H01R 13/52* | (2006.01) |

(52) U.S. Cl.

CPC ..... *H01R 13/6272* (2013.01); *H01R 13/5025* (2013.01); *H01R 13/5219* (2013.01); *H01R 13/629* (2013.01); *H01R 13/64* (2013.01)

(58) Field of Classification Search

CPC ..... H01R 13/6271; H01R 13/6272; H01R 13/6275; H01R 13/514

USPC ..... 439/357, 358, 701

See application file for complete search history.

(56) References Cited

U.S. PATENT DOCUMENTS 4,946,395 A * 8/1990 Cope ..... H01R 13/6272 439/352
5,820,399 A * 10/1998 Shirouzu ..... H01R 13/6275 439/352
5,913,703 A * 6/1999 Suzuki ..... H01R 13/518 439/489

(Continued)

FOREIGN PATENT DOCUMENTS

JP 2003272750 A 9/2003
JP 2015195126 A 11/2015

*Primary Examiner* — Hien Vu

(74) *Attorney, Agent, or Firm* — Kilyk & Bowersox, P.L.L.C.

(57) ABSTRACT

A female connector includes a main body, a base, and a lock arm. The main body includes a connection hole for receiving a male connector, and a slot communicating with the hole. The base is located on the removing direction side relative to the slot. The lock arm includes a first arm with a free end, extending in the receiving direction from the base inside the slot, a middle portion extending from the free end away from the hole, a second arm spaced from the first arm, extending from the middle portion in the removing direction, and a lock projection extending from the free end into the hole for fitting in a lock hole of the male connector or abutting a protrusion of the male connector from the removing direction side. At least the first and second arms and the middle portion can be compressed between the base, and an edge of the lock hole or the protrusion as applying load on the projection.

18 Claims, 19 Drawing Sheets

(56) References Cited

U.S. PATENT DOCUMENTS 5,938,470 A * 8/1999 Kashiyama ..... H01R 13/641
439/357

* cited by examiner

FEMALE CONNECTOR AND CONNECTION STRUCTURE OF FEMALE CONNECTOR AND MALE CONNECTOR

CROSS-REFERENCE TO RELATED APPLICATIONS

The present application claims priority under 35 U.S.C. § 119 of Japanese Patent Application No. 2017-053096 filed on Mar. 17, 2017, and Japanese Patent Application No. 2017-098871 filed on May 18, 2017, the disclosures of which are expressly incorporated by reference herein in their entireties.

BACKGROUND OF THE INVENTION

Technical Field

The invention relates to a female connector and a connection structure of a female connector and a male connector.

Background Art

Japanese Unexamined Patent Publication No. 2015-195126 discloses a conventional connection structure of a female connector and a male connector. The female connector has a tubular female body with a connection hole, and a projection is provided on the outer face of the upper wall of the female body. The male connector has a male body to be removably received into the connection hole of the female connector, and a lock arm is provided in the male body. As used herein the term "receiving direction" means a direction in which the male connector is inserted into the connection hole of the female connector, and the term "removing direction" means a direction in which the male connector is removed from the connection hole of the female connector. The removing direction is opposite to the receiving direction.

The lock arm includes a base, a plate spring, and an operation lever. The base upwardly stands on an end in the removing direction of the male body. The spring extends from the base in the receiving direction and faces the male body with a clearance therebetween. The spring has a free end with lock hole. When the male connector is received in the connection hole of the female connector, the upper wall and the projection of the female connector are received in the clearance between the spring and the male body, and the projection fits in the lock hole. The operation lever is generally U-shaped in plain view, with its two leading portions fixed to respective widthwise ends of the free end of the spring. The operating lever extends in the removing direction, at an upward inclination, from the free end of the spring. When the top of the operation lever is pressed downward, the lock arm elastically deforms such that the free end of the spring is displaced upward with the base as a fulcrum, and the projection of the female connector is disengaged from the lock hole of the spring. When the top of the operating lever is released, the lock arm is restored to its initial form, and the free end of the spring is displaced downward.

SUMMARY OF INVENTION

The plate spring of the lock arm of the male connector extends in the receiving direction, and the lock hole is provided in the free end of the plate spring, which is displaceable upward and downward. As such, when the male connector is pulled in the removing direction, the projection of the female connector presses the edge on the receiving direction side of the lock hole of the plate spring of the male connector, so that the free end of the plate spring is prone to be pressed up, which may result in unintentional disengagement of the projection of the female connector from the lock hole of the male connector.

The invention is made in view of the above circumstances to provide a female connector with a locking mechanism less susceptible to unintentional unlocking. The invention also provides a connection structure of such female connector and a male connector.

A female connector of an aspect of the invention is provided with a body including a main body, a base, and a lock arm. The main body includes a connection hole for removably receiving a male connector and a slot. The slot extends in a receiving direction of the male connector and communicates with the connection hole. The base is located on a removing direction side of the male connector relative to the slot of the main body. The removing direction is opposite to the receiving direction. The lock arm includes a first arm, a middle portion, a second arm, and a lock projection. The first arm extends in the receiving direction from the base inside the slot such as to be adjacent to the connection hole and includes a first free end. The middle portion extends from the first free end of the first arm in a direction away from the connection hole. The second arm extends from the middle portion in the removing direction and is spaced from the first arm. The lock projection extends from the first free end of the first arm toward and into the connection hole. The lock projection is configured to fit in a lock hole of the male connector or abut a protrusion of the male connector from the removing direction side. At least the first arm, the middle portion, and the second arm are configured to be compressed by and between the base and an edge on the receiving direction side of the lock hole of the male connector, or by and between the base and the protrusion of the male connector, when the lock projection is subjected to load in the removing direction from the edge or the protrusion of the male connector.

In the female connector of this aspect, the lock arm includes the first arm extending in the receiving direction from the base, the middle portion extending from the first free end of the first arm in a direction away from the connection hole, and the second arm extending in the removing direction from the middle portion. In short, the first arm, the middle portion, and the second arm collectively form a generally lateral U-shape. This generally lateral U-shaped portion of the lock arm will be hereinafter referred to as a lock arm body. When the lock projection is subjected to load in the removing direction, at least the lock arm body of the lock arm is compressed by and between the base and the edge or the protrusion of the male connector, so that the load is absorbed. The load, thus absorbed, hardly acts in such a manner as to displace the lock projection of the lock arm in a direction away from the connection hole. Consequently, the lock projection of the lock arm securely fits in the lock hole or securely abuts the projection of the male connector. The lock projection of the lock arm thus securely locked is resistant to unintentional release of the locking.

The lock arm may further include a leading face on the receiving direction side. The leading face may be provided at the lock projection and include a leading end, a far end, and an inclined face. The leading end may be an edge constituted by an end face on the receiving direction side and an end face on the connection hole side of the lock projection. The far end may be located farther away from the connection hole than the leading end. The inclined face may slope down in the receiving direction from the far end to the leading end. At least the first arm, the middle portion, and the second arm may be configured to be compressed by and between the base and the edge or protrusion of the male connector such that the inclined face of the lock projection is displaced in the removing direction when the inclined face is subjected to load in the removing direction from the edge or protrusion of the male connector.

In the female connector of this aspect, the lock projection of the lock arm in the locked state is further resistant to unintentional release of the locking with the lock hole or the projection of the male connector (resistant to unintentional release of the fitting to the lock hole or of the abutment on the protrusion of the male connector). This is because at least the lock arm body of the lock arm is compressed by and between the base and the edge or the protrusion of the male connector such that the inclined face is displaced in the removing direction when the inclined face is subjected to load in the removing direction.

The leading face may be provided at the lock projection and the first free end, in which case the far end of the leading face may be provided in the first free end. The leading face may alternatively be provided at the lock projection, the first free end, and the middle portion, in which case the far end of the leading face may be provided in the middle portion. In either case, the inclined face of the leading face may include a contact portion being an end face on the receiving direction side of the lock projection. At least the first arm, the middle portion, and the second arm may be configured to be compressed by and between the base and the edge or protrusion of the male connector such that the inclined face is displaced in the removing direction when the contact portion of the lock projection is subjected to load in the removing direction from the edge of the lock hole of the male connector or the protrusion of the male connector.

In the female connector of this aspect, the lock projection of the lock arm in the locked state is further resistant to unintentional release of the locking with the lock hole or the projection of the male connector. The inclined face is provided at the lock projection and the first free end, or provided at the lock projection, the first free end, and the middle portion. Consequently, when the contact portion of the inclined face of the lock projection is subjected to load in the removing direction, at least the lock arm body of the lock arm is readily compressed by and between the base and the edge or the protrusion of the male connector.

The second arm may include a second free end opposed to and spaced from the first arm or the base. In this case, when the second free end is pressed toward the connection hole, the second arm may elastically deform until the second free end abuts at least one of the first arm and the base, and the first arm may elastically deform with the base as a fulcrum such that the first free end and the lock projection are displaced in a direction away from the connection hole.

In the female connector of this aspect, the second free end abuts at least one of the first arm and the base, thereby preventing the second arm from elastically deforming further toward the at least one of the first arm side and the base side.

A female connector according to another aspect of the invention includes a body and a seal. The body has a connection hole for removably receiving a male connector along a first direction. One side of the first direction is the receiving direction, and the other side of the first direction is the removing direction. The body includes a first body and a second body. The first body includes a first chamber and a second chamber. The first chamber forms part of the connection hole and accommodates the seal such that the seal is in close contact, from a direction orthogonal to the first direction, with the male connector as received in the connection hole. The second chamber is a space on the other side in the first direction relative to the first chamber of the first body. The second body is received in the second chamber from one side in a second direction and fixed in the first direction by the first body. The second direction crosses the first direction. The second body includes a through-hole and a stop abutment. The through-hole forms part of the connection hole and extends through the second body in the first direction. The through-hole is located on the other side in the first direction relative to the first chamber. The stop abutment is located on the other side in the first direction relative to the seal.

The female connector of this aspect has a reduced possibility that the second body becomes detached in the other side of the first direction (in the removing direction). The reasons are as follows. The stop abutment of the second body is located on the other side of the first direction relative to the seal. The second body is received in the second chamber from the one side of the second direction and fixed in the first direction by the first body. As such, even if the male connector as connected to the connection hole is moved to the other side of the first direction such that the seal is subjected to load to the other side of the first direction, the first body restricts the movement of the seal and the second body to the other side of the first direction (in the removing direction).

The seal may be a loop-shaped body configured to receive therein the male connector. Alternatively, a plurality of the seals may be provided in a loop-shaped arrangement, and the seals may be accommodated in the first chamber and define a space to receive therein the male connector. The second body may further include a circumferential wall of the through-hole. The stop abutment may be provided on the circumferential wall of the second body.

The female connector of this aspect is configured such as to facilitate placement of the stop abutment of the second body on the other side of the first direction relative to the at least one seal. This is because the stop abutment is provided on the circumferential wall of the through-hole of the second body. The stop abutment of the second body can be disposed on the other side of the first direction relative to the at least one seal simply by inserting the second body into the second chamber of the first body from the one side of the second direction.

The first body may further include a first abutment located on the other side of the first direction relative to the second chamber. The first abutment may abut, from the other side in the first direction, the second body accommodated in the second chamber. The female connector of this aspect has a reduced possibility that the second body becomes detached to the other side of the first direction because the first abutment abuts the second body from the other side in the first direction.

The first body may further include a second abutment located on the one side of the first direction relative to the second chamber. The second abutment may abut, from the one side of the first direction, the second body accommodated in the second chamber.

The second abutment may be configured to hold, on the one side of the first direction relative to the second body, the male connector as received in the connection hole. The first abutment may be configured to hold, on the other side of the first direction relative to the second body, the male connector as received in the connection hole.

For the female connector of this aspect, when the male connector as received in the connection hole is twisted or pried (when the male connector is operated so as to be moved in a direction crossing the first direction), the movement of the male connector causes application of load to the first and second bodies. However, the first abutment and the second abutment of the first body hold the male connector on the opposite sides in the first direction of the second body, so that the applied load is dispersed to the first and second abutments, and reducing the load applied to the second body.

The second body may include an engagement portion. The engagement portion may be adjacent to the through-hole and engageable with the male connector as received in the connection hole.

The female connector of this aspect has improved tensile strength to the other side of the first direction. This is because the engagement portion is provided in the second body fixed to the first body in the first direction.

The first body may include an engagement portion. The engagement portion of the first body may be engageable with the male connector as received in the connection hole.

In the female connector of this aspect, because of the engagement portion provided in the first body, the second body will not be subjected to load generated by the movement of the male connector to the other side of the first direction. The engagement portion of any aspect described above may or may not be the lock projection of the lock arm.

The circumferential wall of the through-hole may be provided with a guide extending in the first direction. The guide may be a guide projection configured to be received in a guide groove of the male connector or may be a guide groove configured to receive a guide projection of the male connector.

The female connector of this aspect, because of the guide provided in the second body, it is only necessary to replace the second body in order to make the female connector compatible with a male connector with a guide projection or a guide groove of different type.

A connection structure of the female connector and the male connector of an aspect of the invention may include a female connector of any of the above aspects and a male connector. The male connector may include a lock hole or a protrusion. In a state where the male connector is received in the connection hole of the female connector, the lock projection of the female connector may fit in the lock hole of the male connector, or alternatively may abut the protrusion of the male connector from the removing direction side. At least the first arm, the middle portion, and the second arm of the lock arm of the female connector may be configured to be compressed by and between the base and the edge on the receiving direction side of the lock hole of the male connector, or by and between the base and the protrusion of the male connector, when the lock projection of the female connector is subjected to load in the removing direction from the edge or the protrusion of the male connector.

The lock arm of the female connector may be pivotable with the base as a fulcrum when the second free end of the second arm of the lock arm is pressed toward the connection hole, such that the first free end of the first arm of the lock arm and the lock projection are displaced in a direction away from the connection hole, thereby releasing the fitting of the lock projection of the female connector in the lock hole of the male connector or releasing the abutment of the lock projection of the female connector on the protrusion of the male connector.

BRIEF DESCRIPTION OF DRAWINGS

The present invention can be even more fully understood with the reference to the accompanying drawings which are intended to illustrate, not limit, the present invention.

Figure 1:
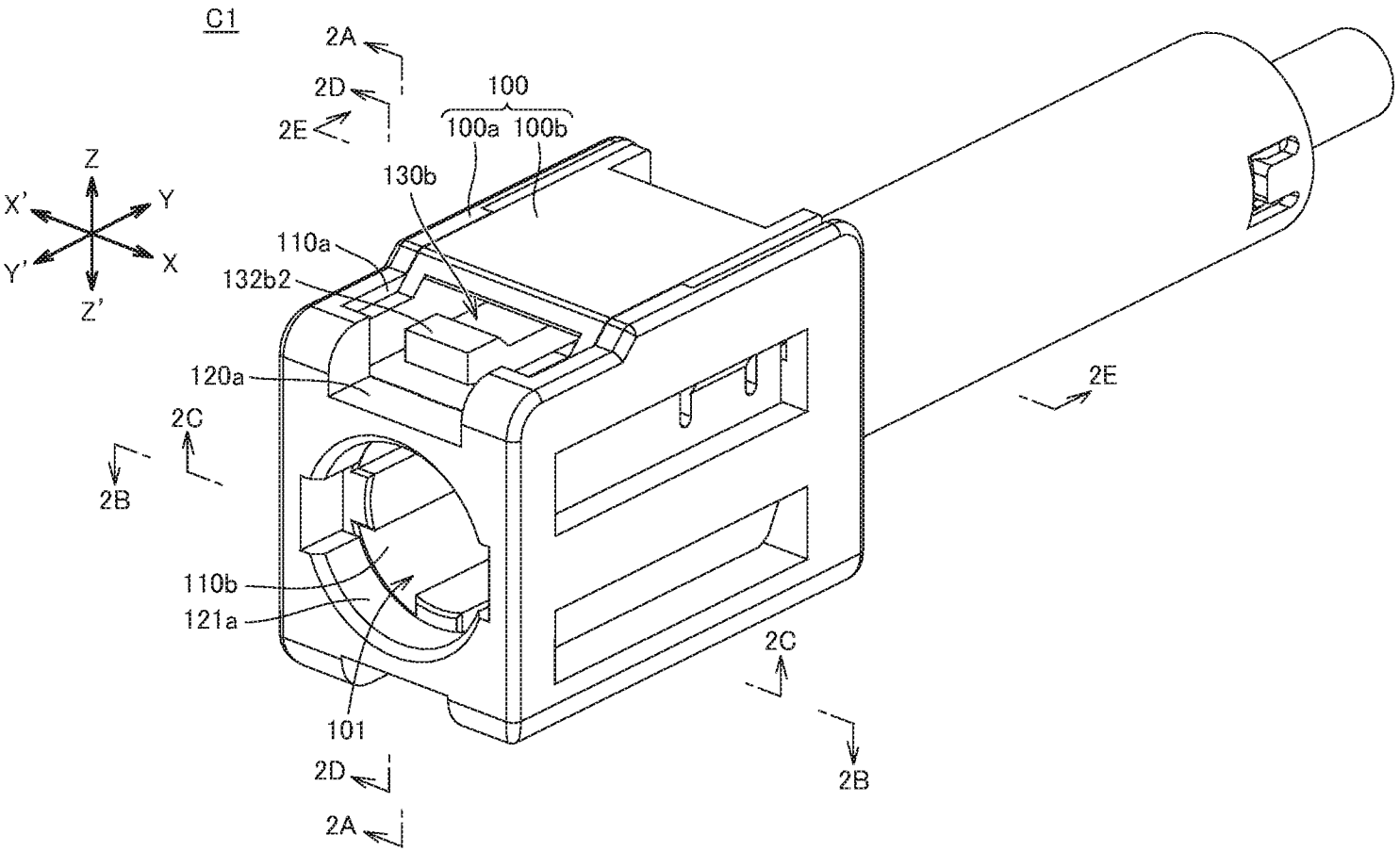
FIG. 1 is a front top right perspective view of a female connector according to a first embodiment of the invention.

In the brief description of the drawings above and the description of embodiments which follows, relative spatial terms such as "upper", "lower", "top", "bottom", "left", "right", "front", "rear", etc., are used for the convenience of the skilled reader and refer to the orientation of the female connector and the connection structure and their constituent parts as depicted in the drawings. No limitation is intended by use of these terms, either in use of the invention, during its manufacture, shipment, custody, or sale, or during assembly of its constituent parts or when incorporated into or combined with other apparatus.

DESCRIPTION OF EMBODIMENTS

The following discussion is directed to various embodiments of the invention.

First Embodiment

Figure 5:
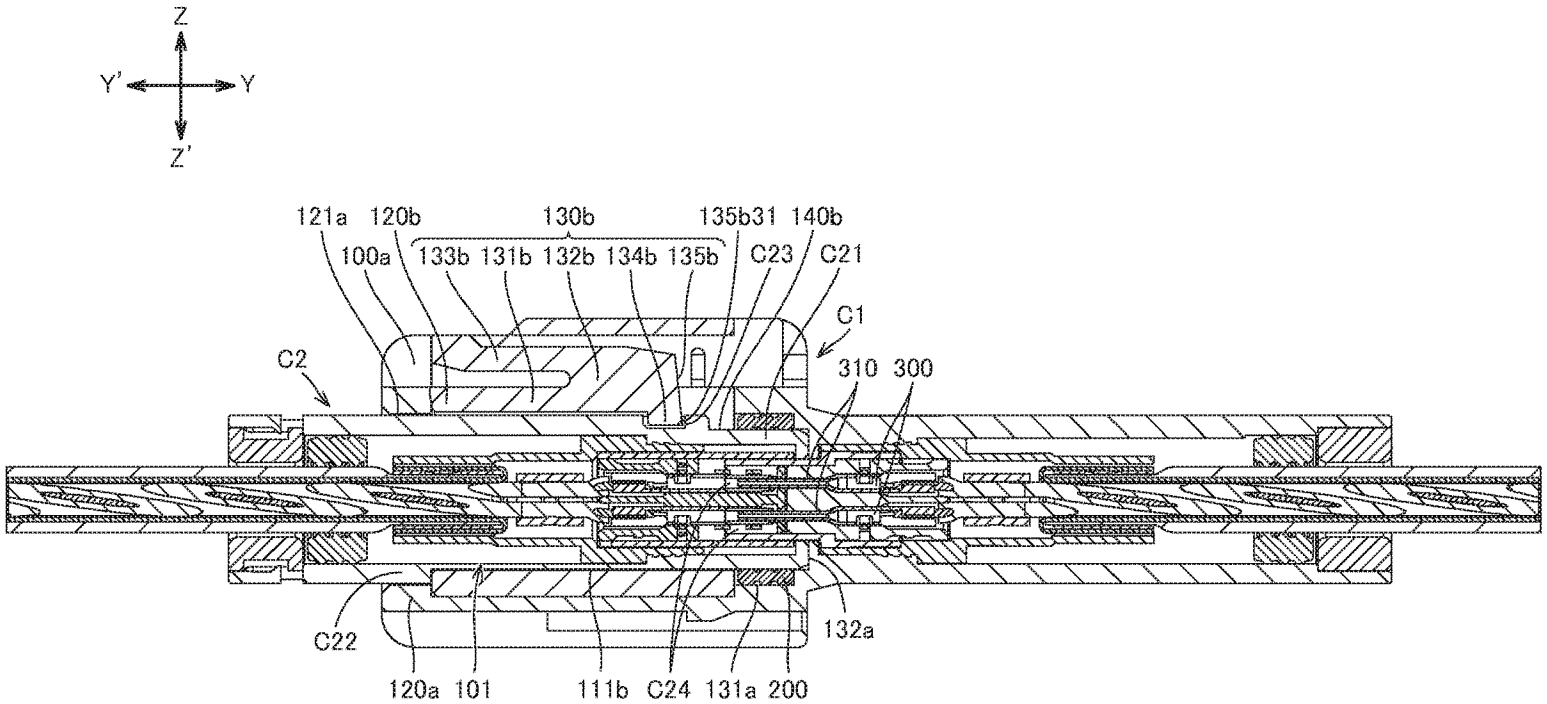
FIG. 5 is a sectional view, corresponding to FIG. 2D, of the female connector and a male connector connected thereto of the first embodiment of the invention.

A female connector C1 according to a plurality of embodiments including the first embodiment of the invention will now be described with reference to FIGS. 1 to 5, and a connection structure of the female connector C1 and a male connector C2 according to the same embodiments will be described with reference to FIG. 5. FIGS. 1 to 5 illustrate the female connector C1 of the first embodiment, and FIG. 5 illustrates the connection structure of the female connector C1 and the male connector C2 of the first embodiment. The Y-Y' direction indicated in FIGS. 1 to 2D, and 5 is the direction in which the male connector C2 is received in and removed from a connection hole 101 of the female connector C1 (the receiving/removing direction). In the Y-Y' direction, the Y direction is the direction in which the male connector C2 is received in the connection hole 101 of the female connector C1 (the receiving direction), and Y' direction is the direction in which the male connector C2 is removed from the connection hole 101 of the female connector C1 (the removing direction). The Z-Z' direction indicated in FIGS. 1 to 2A, 2D to 2E, and 5 is orthogonal to the Y-Y' direction. The X-X' direction indicated in FIGS. 1, 2B, 2C, and 2E is orthogonal to the Y-Y' and Z-Z' directions.

The female connector C1 includes a body 100. The body 100 includes the connection hole 101 for receiving and removing the male connector C2 in the Y-Y' direction. The body 100 includes a first body 100*a* and a second body 100*b*, which are made of an insulating resin.

Figure 2A:
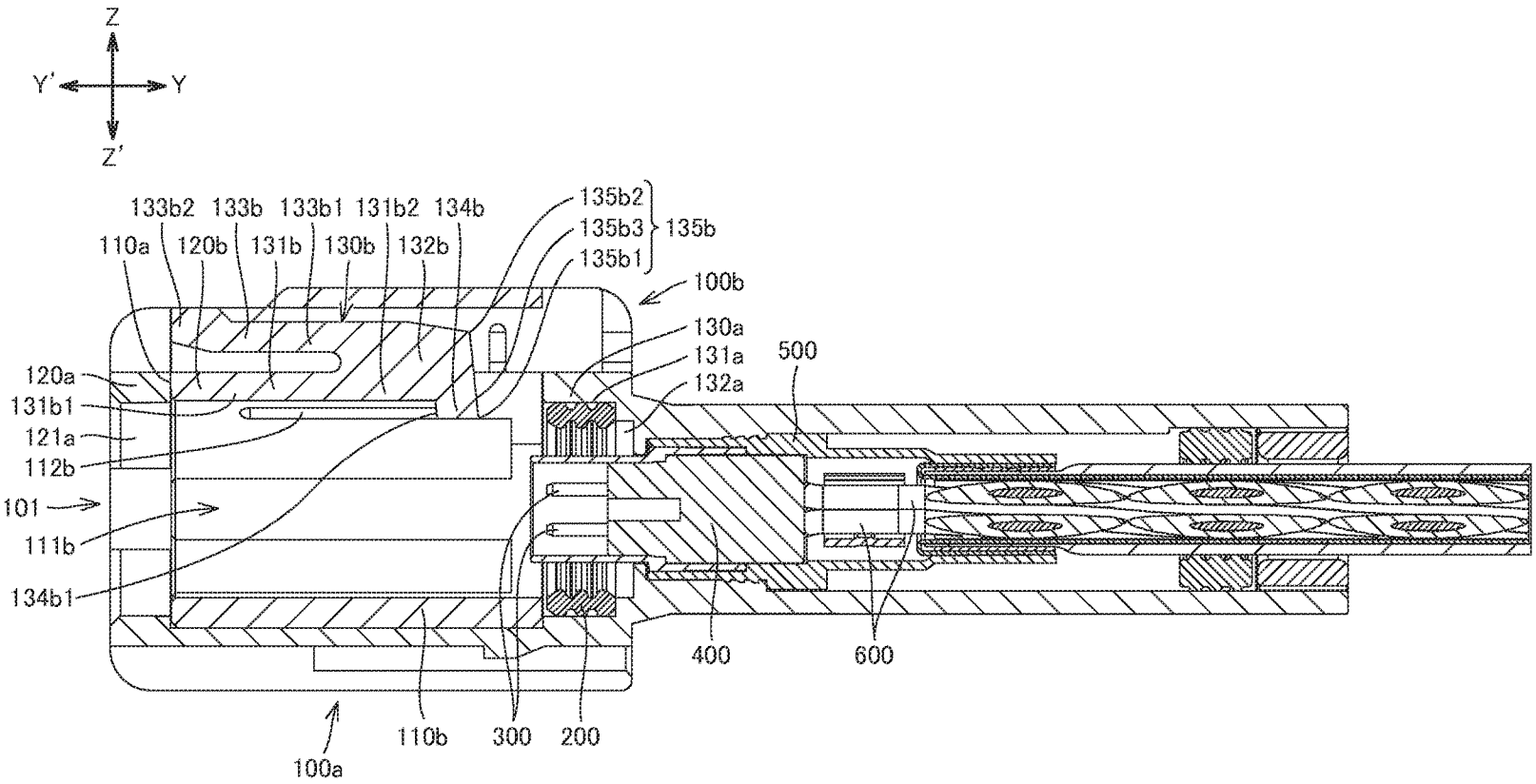
FIG. 2A is a sectional view of the female connector, taken along a line 2A-2A in FIG. 1.
Figure 2B:
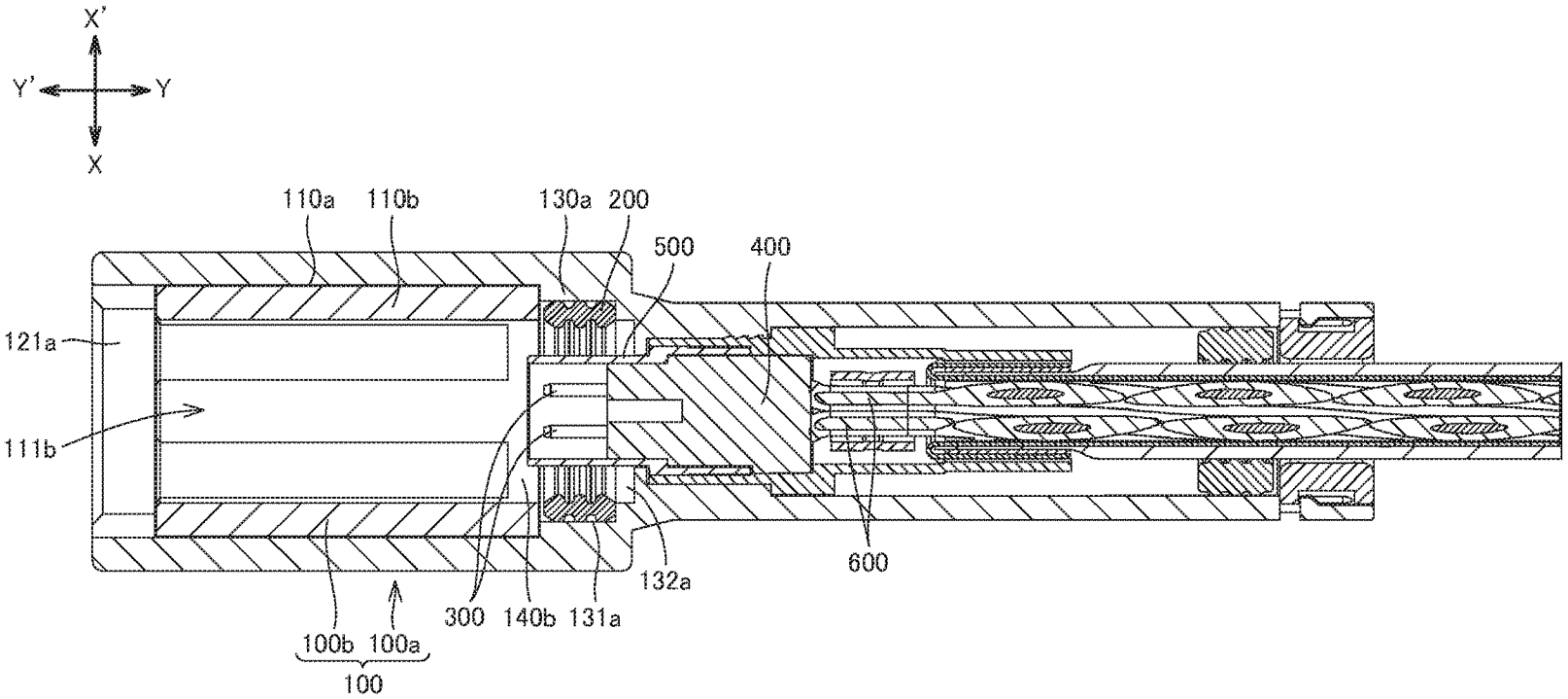
FIG. 2B is a sectional view of the female connector, taken along a line 2B-2B in FIG. 1
Figure 2C:
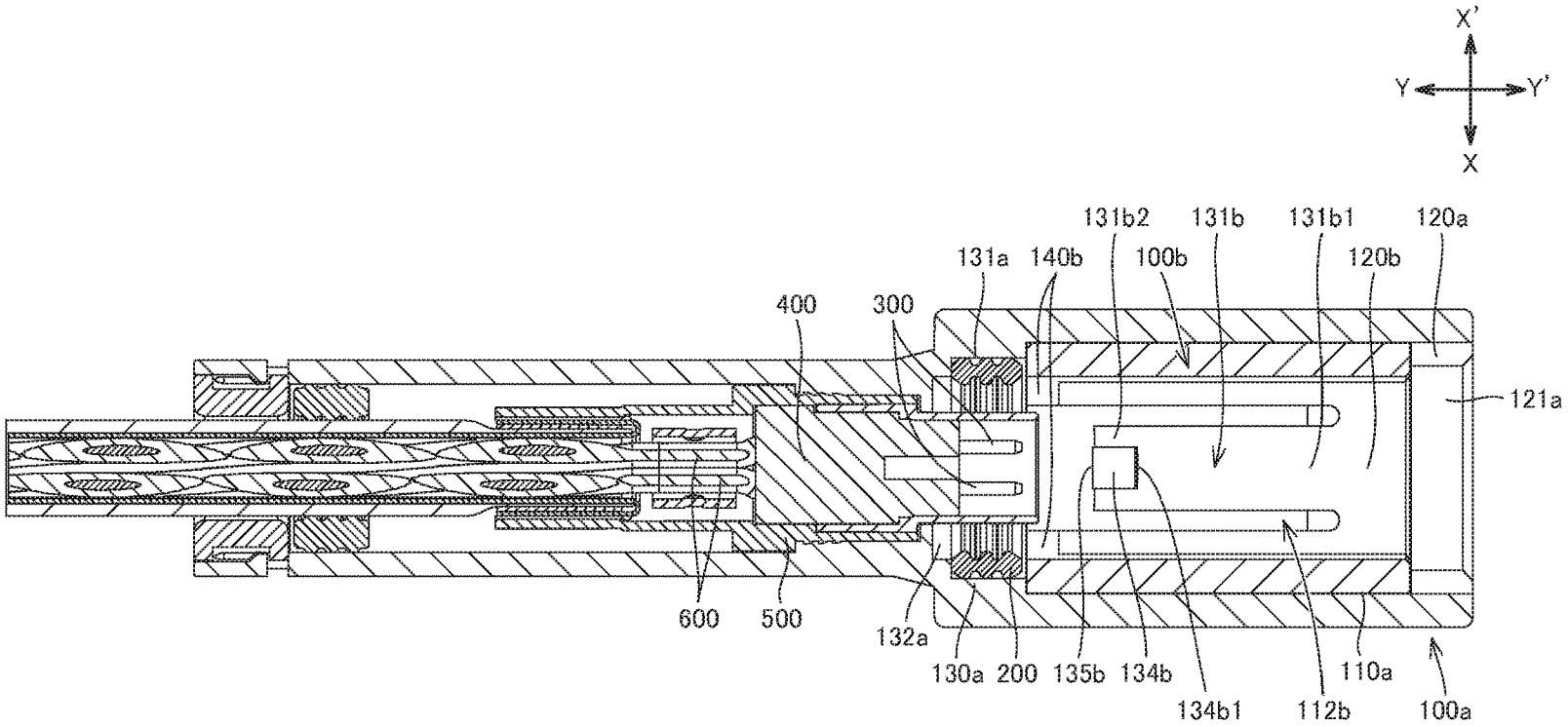
FIG. 2C is a sectional view of the female connector, taken along a line 2C-2C in FIG. 1
Figure 2D:
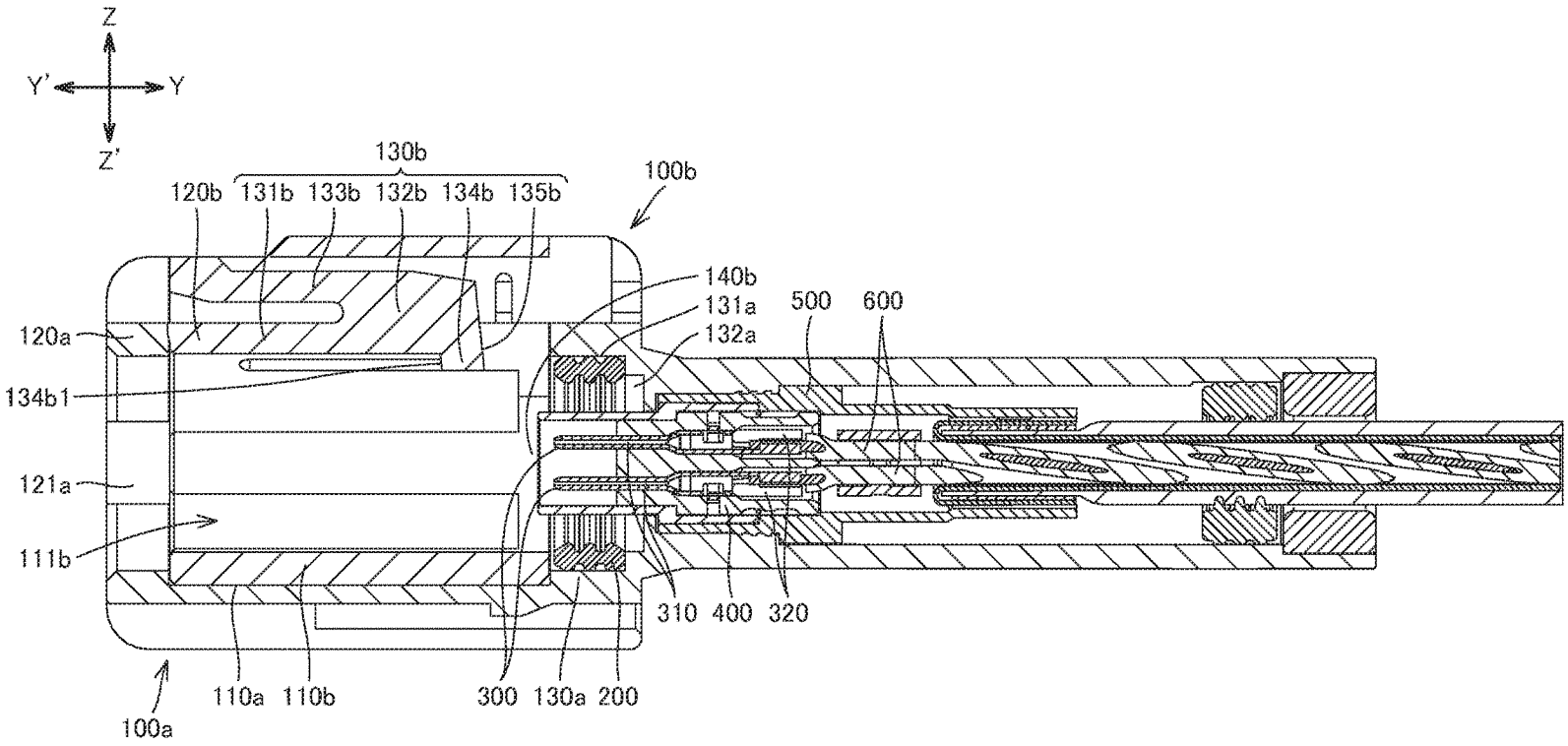
FIG. 2D is a sectional view of the female connector, taken along a line 2D-2D in FIG. 1
Figure 2E:
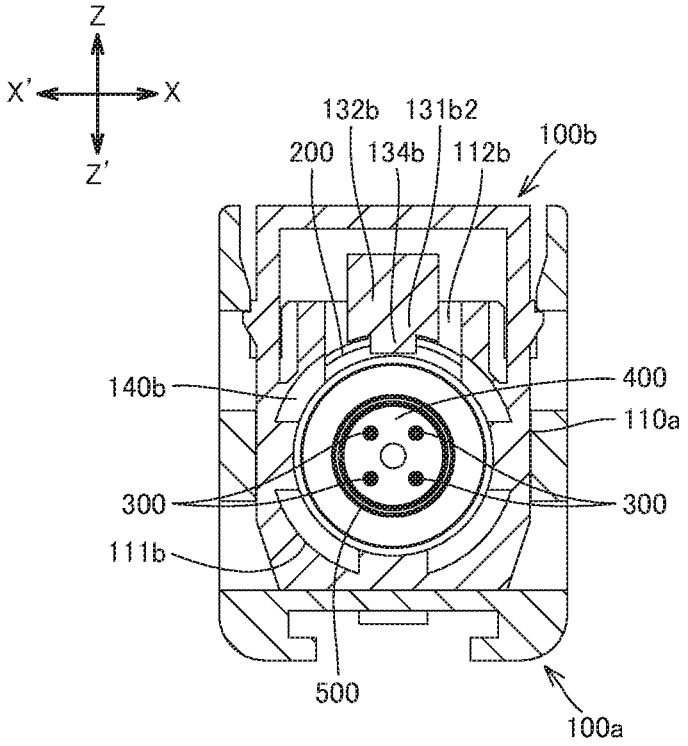
FIG. 2E is a sectional view of the female connector, taken along a line 2E-2E in FIG. 1
Figure 3:
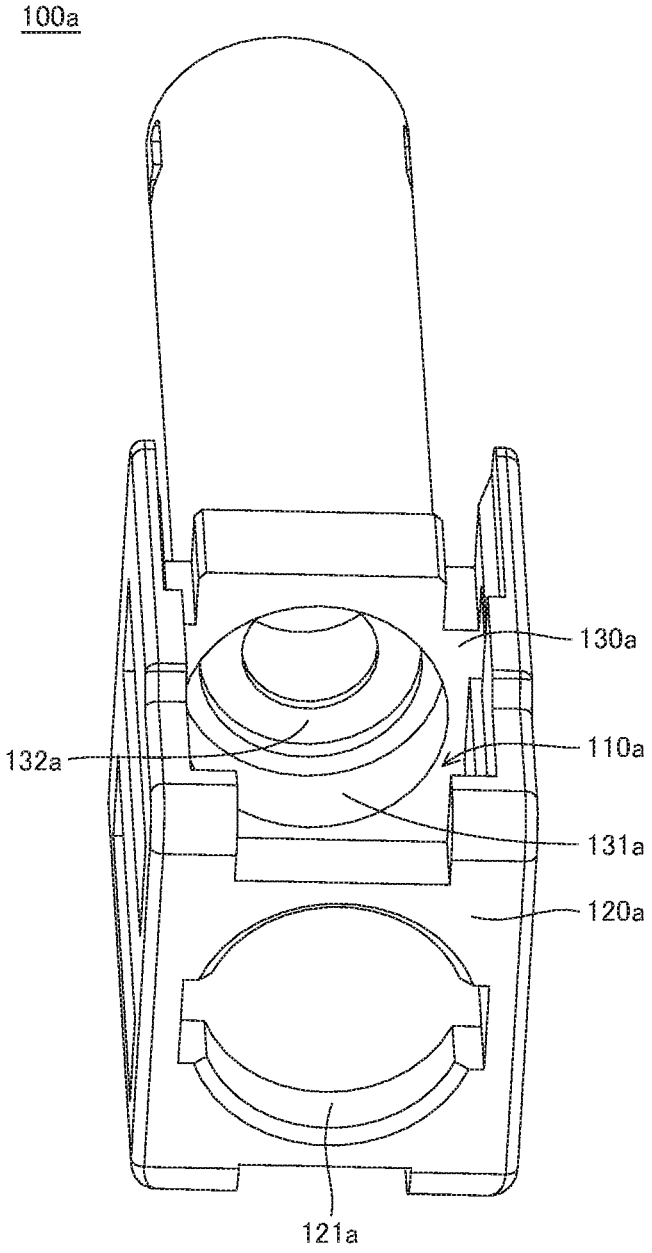
FIG. 3 is a front top left perspective view of a first body of the female connector.
Figure 4A:
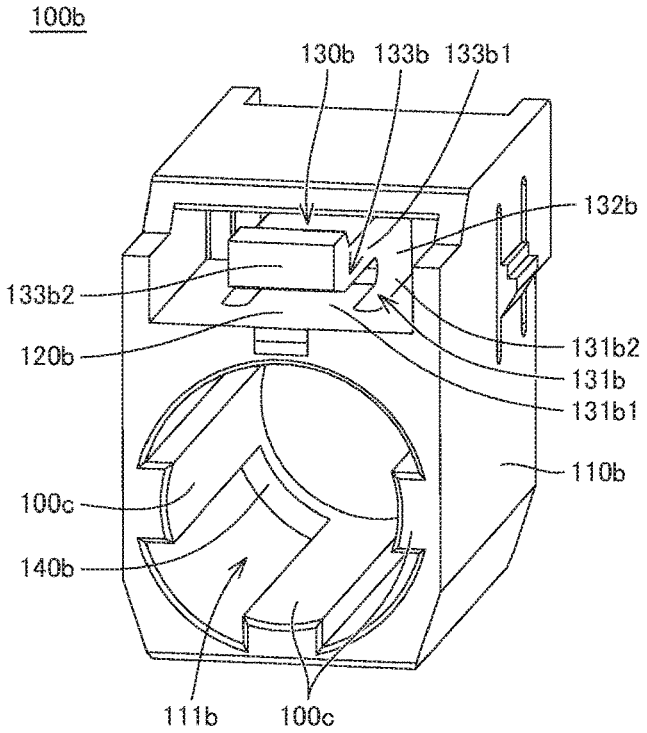
FIG. 4A is a front top right perspective view of a second body of the female connector.
Figure 4B:
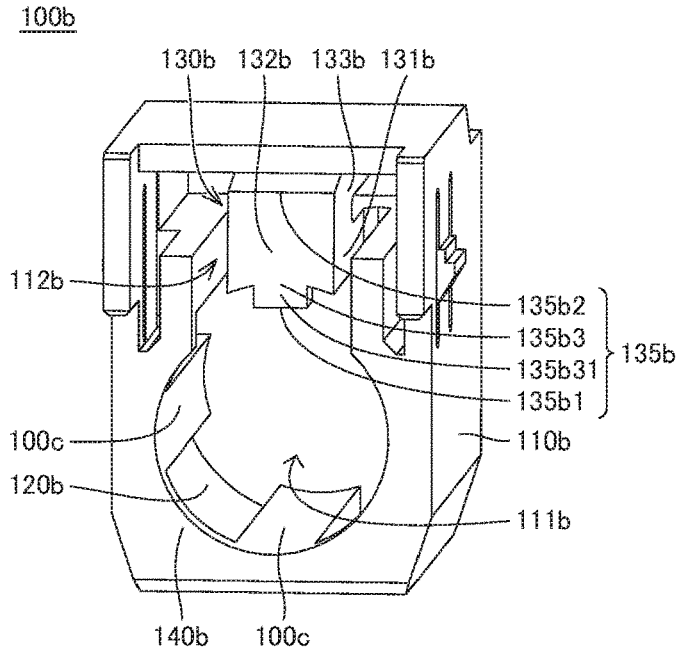
FIG. 4B is a rear top and left perspective view of the second body of the female connector.

The first body 100*a* includes a first chamber 110*a*, a first abutment 120*a*, and a second abutment 130*a*. The first chamber 110*a* is defined by the first abutment 120*a* and the second abutment 130*a*. For example, as illustrated in FIGS. 1 to 3, the first chamber 110*a* may be formed as a bottomed hole extending in the Z-Z' direction and opening at least in the Z direction. Alternatively, the first chamber 110*a* may be formed as a through-hole extending through the first body 100*a* in the Z-Z' direction. In either case, the second body 100*b* is received in the first chamber 110*a* from the Z-direction side and fixed in position in the Y-Y' direction by the first body 100*a*. The second body 100*b* may be removably received in the first chamber 110*a*, but it may be unremovable once fixed into the first chamber 110*a*.

The first abutment 120*a* is located on the Y'-direction side relative to the first chamber 110*a* and abuts, from the Y'-direction side, the second body 100*b* as accommodated in the first chamber 110*a*. The first abutment 120*a* restricts movement of the second body 100*b* in the Y' direction. The second abutment 130*a* is located on the Y-direction side relative to the first chamber 110*a* and abuts, from the Y-direction side, the second body 100*b* as accommodated in the first chamber 110*a*. The second abutment 130*a* restricts movement of the second body 100*b* in the Y direction. The first abutment 120*a* and the second abutment 130*a* may have any configurations abuttable on the second body 100*b* in the above manners. For example, the first abutment 120*a* and the second abutment 130*a* may each be a wall (see FIGS. 1A to 3), a projection, or a lug.

The second body 100*b* includes a main body 110*b*. The main body 110*b* includes a main hole 111*b*. The main hole 111*b* is a hole forming at least part of the connection hole 101 and extends through the main body 110*b* in the Y-Y' direction. The first abutment 120*a*, if being a wall, may have an opening 121*a* extending through the first abutment 120*a* in the Y-Y' direction and communicating with the main hole 111*b* on the Y'-direction side of the main hole 111*b* of the second body 100*b*. The first abutment 120*a*, if having no opening 121*a*, may preferably be not a wall but a projection, a lug, or the like. The second abutment 130*a*, if being a wall, may have a first hole 131*a* opening in the Y' direction and communicating with the main hole 111*b* on the Y-direction side of the main hole 111*b* of the second body 100*b*. The second abutment 130*a* may further have a second hole 132*a* communicating with the first hole 131*a* on the Y-direction side of the first hole 131*a*.

The connection hole 101 may have any one of the following configurations A) to F), for example:

A) The connection hole 101 is constituted only by the main hole 111*b*. In this case, the opening 121*a*, the first hole 131*a*, and the second hole 132*a* are not provided.

B) The connection hole 101 is constituted by the main hole 111*b* and the opening 121*a*. In this case, the first hole 131*a* and the second hole 132*a* are not provided.

C) The connection hole 101 is constituted by the main hole 111*b* and the first hole 131*a*. In this case, the opening 121*a* and the second hole 132*a* are not provided.

D) The connection hole 101 is constituted by the main hole 111*b*, the opening 121*a*, and the first hole 131*a*. In this case, the second hole 132*a* is not provided.

E) The connection hole 101 is constituted by the main hole 111*b*, the first hole 131*a*, and the second hole 132*a*. In this case, the opening 121*a* is not provided.

F) The connection hole 101 is constituted by the main hole 111*b*, the opening 121*a*, the first hole 131*a*, and the second hole 132*a* (see FIGS. 1 to 5).

The connection hole 101 may have any inner shape adapted to removably receive the male connector C2 therein along the Y-Y' direction. Particularly, at least part in the Y-Y' direction of the connection hole 101 may have an inner size corresponding to the outer size of at least part in the Y-Y' direction of the male connector C2, so that the connection hole 101 can hold therein the at least part of the male connector C2. For example, the inner size of the main hole 111*b* may correspond to the outer size of the male connector C2 so that the main hole 111*b* can hold therein the male connector C2. If the second abutment 130*a* is provided with the second hole 132*a*, the inner size of the second hole 132*a* may correspond to the outer size of a leading portion C21 of the male connector C2 so that the second hole 132*a* can hold therein the leading portion C21 of the male connector C2. If the first abutment 120*a* is provided with the opening 121*a*, the inner size of the opening 121*a* may correspond to the outer size of a far portion C22 of the male connector C2 so that the opening 121*a* can hold therein the far portion C22 of the male connector C2. It should be appreciated that the far portion C22 is the farther side of the male connector C2 with respect to the female connector C1, i.e. located on the Y'-direction side relative to the leading portion C21 of the male connector C2.

The main body 110*b* further includes a slot 112*b*. The slot 112*b* is an elongated hole extending in the Y direction in the circumferential wall of the main hole 111*b* of the main body 110*b*. The circumferential wall is a tuboid wall extending in the Y-Y' direction. The slot 112*b* communicates with, and is located on the Z-direction side relative to, the main hole 111*b*.

The second body 100*b* further includes a base 120*b*. The base 120*b* is a portion of the circumferential wall of the main hole 111*b*, located on the Y'-direction side relative to the slot 112*b* in the main body 110*b*, and serves as an edge on the Y'-direction side of the slot 112*b*.

The second body 100*b* further includes a lock arm 130*b*. The lock arm 130*b* includes a lock arm body, and the lock arm body includes a first arm 131*b*, a middle portion 132*b*, and a second arm 133*b*. The lock arm body of the lock arm 130*b* may be made of an insulating resin or a metal plate. Alternatively, at least one of the first arm 131*b*, the middle portion 132*b*, and the second arm 133*b* of the lock arm 130*b* may be made of an insulating resin and the remaining may be made of metal. In either case, the lock arm body of the lock arm 130*b*, in cross-section cut along the Z-Z' direction, generally has a lateral U-shape opening in the Y' direction. As used herein the term "lateral U-shape in cross-section" includes a lateral V-shape in cross-section and a lateral square U-shape in cross-section.

The first arm 131*b* extends from the base 120*b* in the Y direction inside the slot 112*b* such as to be adjacent to the main hole 111*b*. A clearance is provided between the first arm 131*b* and each of the edges in the X-X' direction of the slot 112*b* of the main body 110*b*. The first arm 131*b* includes a first fixed end 131*b*1 and a first free end 131*b*2. The first fixed end 131*b*1 is integrally contiguous with or fixed to the base 120*b*. The first arm 131*b* is elastically deformable, with the base 120*b* as a fulcrum, such that the first free end 131*b*2 is displaced in a direction away from the main hole 111*b* (displaced in the Z direction).

The middle portion 132*b* extends from the first free end 131*b*2 of the first arm 131*b* in a direction away from the main hole 111*b*, i.e. in the Z direction. If formed of a metal plate, the middle portion 132*b* may preferably folded back to the Z- and Y'-direction sides.

The second arm 133*b* extends in the Y' direction from the middle portion 132*b* and is spaced from the first arm 131*b* in the Z-Z' direction. The second arm 133*b* includes a second fixed end 133*b*1 and a second free end 133*b*2. The second fixed end 133*b*1 is integrally contiguous with or fixed to the middle portion 132*b*. The lock arm 130*b* is pivotable substantially in the Z-Z' direction, with the base 120*b* as the fulcrum, by pressing the second free end 133*b*2 (point of effort) toward the connection hole 101, i.e. in the Z' direction.

The second free end 133*b*2 may preferably be opposed to and spaced in the Z-Z' direction from the first arm 131*b* and/or the base 120*b*. In this case, the second arm 133*b* may be elastically deformable such that the second free end 133*b*2 is displaced toward the first arm 131*b* and/or the base 120*b*, i.e. displaced in the Z' direction. The second arm 133*b* may, but not necessarily, elastically deform until the second free end 133*b*2 abuts the first arm 131*b* and/or the base 120*b*. That is, even when elastically deformed to the maximum degree, the second free end 133*b*2 may be located with a clearance in the Z-Z' direction between itself and the first arm 131*b* and/or the base 120*b*.

Alternatively, the second arm 133*b* may have a dimension in the Y-Y' direction that is larger than the sum of the dimension in the Y-Y' direction of the first arm 131*b* and the base 120*b*, so that the second free end 133*b*2 is not opposed to the first arm 131*b* or the base 120*b* in the Z-Z' direction. Even in this case, the second arm 133*b* may elastically deform such that the second free end 133*b*2 is displaced in the Z' direction. Irrespective of its size, the second arm 133*b* may be elastically undeformable.

The lock arm 130*b* further includes a lock projection 134*b*. The lock projection 134*b* extends from the first free end 131*b*2 of the first arm 131*b* toward the main hole 111*b*, i.e. extends in the Z' direction. In other words, the lock projection 134*b* extends from a vertex of the lock arm body of lateral U-shape in cross-section toward the main hole 111*b* (in the Z' direction). The lock projection 134*b* is initially located at a "lock position" in the main hole 111*b*. The lock projection 134*b* at the lock position can fit in a lock hole C23 of the male connector C2 as received in the connection hole 101 of the female connector C1. The lock projection 134*b* can be displaced in the Z direction from the lock position to a "displacement position" in accordance with the displacement in the Z direction of the first free end 131*b*2 of the first arm 131*b*. The displacement position is on the Z-direction side relative to the lock position. When the lock projection 134*b* as fitting in the lock hole C23 of the male connector C2 moves to the displacement position, the lock projection 134*b* becomes disengaged from the lock hole C23.

The lock projection 134*b* is a projection of an insulating resin or a metal in the shape of a polygonal prism (e.g. a quadrangular prism as shown in FIGS. 2A to 2E and 4A to 4B), a circular cylinder, a flat plate, a substantially semicircle in cross-section in the Z-Z' direction, a hemisphere, etc. Particularly, the lock projection 134*b* may have any one of the following configurations 1) to 4), for example:

1) Provided that the first arm 131*b* is made of an insulating resin, the lock projection 134*b* is made of an insulating resin and integrally contiguous with the first free end 131*b*2 of the first arm 131*b*.

2) Provided that the first arm 131*b* is made of an insulating resin, the lock projection 134*b* is made of a metal and fixed to the first free end 131*b*2 of the first arm 131*b*.

3) Provided that the first arm 131*b* is made of a metal plate, the lock projection 134*b* is part of the same metal plate, formed by cutting a part of the first free end 131*b*2 of the first arm 131*b* and bending the part to extend in the Z'-direction.

4) Provided that the first arm 131*b* is made of a metal plate, the lock projection 134*b* is made of an insulating resin fixed to the first free end 131*b*2 of the first arm 131*b*.

The lock projection 134*b* may be provided with an inclined face 134*b*1. The inclined face 134*b*1 is an end face on the Y'-direction side of the lock projection 134*b*. The inclined face 134*b*1 slopes down in the Y direction from its Z-direction end to its Z'-direction end. When the male connector C2 is received into the connection hole 101 of the female connector C1, the edge on the Y-direction side of the lock hole C23 of the male connector C2 presses the inclined face 134*b*1, which assists the lock arm 130*b* to rotate with the base 120*b* as the fulcrum. The lock projection 134*b* may be provided without the inclined face 134*b*1.

The lock arm 130*b* further includes a leading face 135*b* on the Y-direction side. The leading face 135*b* may be configured to include a leading end 135*b*1, a far end 135*b*2, and an inclined face 135*b*3. The leading end 135*b*1 is an edge constituted by the Y-direction-side end face of the lock projection 134*b* and the end face on the side of the main hole 111*b* (Z'-direction-side end face) of the lock projection 134*b*. In the leading face 135*b*, the far end 135*b*2 is located farther away from the main hole 111*b* than the leading end 135*b*1, i.e. located on the Z-direction side relative to the leading end 135*b*1. The inclined face 135*b*3 slopes down in the Y direction from the far end 135*b*2 to the leading end 135*b*1.

The leading face 135*b* may particularly have any one of the following configurations 1) to 3), for example:

Configuration 1): the leading face 135*b* is provided only at the lock projection 134*b*. In other words, the leading face 135*b* is the Y-direction-side end face of the lock projection 134*b*. In this case, the far end 135*b*2 of the leading face 135*b* may be the boundary between the lock projection 134*b* and the first free end 131*b*2 of the first arm 131*b*. Alternatively, the far end 135*b*2 may be located on the Z'-direction side relative to such boundary. The inclined face 135*b*3 can abut against the edge on the Y-direction side of the lock hole C23 of the male connector C2 such as to bite into the edge.

Configuration 2): the leading face 135*b* is provided at the lock projection 134*b* and the first free end 131*b*2 of the first arm 131*b*. In other words, the leading face 135*b* is the Y-direction-side end face of the lock projection 134*b* and the first free end 131*b*2. In this case, the Y-direction-side end face of the lock projection 134*b* is flush with the Y-direction-side end face of the first free end 131*b*2. The far end 135*b*2 of the leading face 135*b* may be the boundary between the first free end 131*b*2 of the first arm 131*b* and the middle portion 132*b*. Alternatively, the far end 135*b*2 may be located on the Z'-direction side relative to such boundary and within the first free end 131*b*2. The inclined face 135*b*3 includes a contact portion 135*b*31, which is the Y-direction-side end face of the lock projection 134*b*, and the contact portion 135*b*31 can abut against the edge on the Y-direction side of the lock hole C23 of the male connector C2 such as to bite into the edge.

Configuration 3): as illustrated in FIGS. 1 to 5, the leading face 135*b* is provided at the lock projection 134*b*, the first free end 131*b*2, and the middle portion 132*b*. In other words, the leading face 135*b* is the Y-direction-side end face of the lock projection 134*b*, the first free end 131*b*2, and the middle portion 132*b*. In this case, the Y-direction-side end face of the lock projection 134*b*, the Y-direction-side end face of the first free end 131*b*2, and the Y-direction-side end face of the middle portion 132*b* are flush with one another. The far end 135*b*2 may be the Z-direction-side end of the middle portion 132*b*. Alternatively, the far end 135*b*2 may be located on the Z'-direction side relative to such end and within the middle portion 132*b*. The inclined face 135*b*3 includes the contact portion 135*b*31.

It should be appreciated that with respect to the length of the inclined face 135*b*3, configuration 1) is the smallest, configuration 3) is the largest, and configuration 2) is between configurations 1) and 3).

The inclined face 135*b*3 may extend at an inclination angle in a range of between 80° and 90° with respect to the Z'-direction-side face of the lock projection 134*b*, but the inclination angle is not limited to this range. The leading face 135*b* does not necessarily include the inclined face 135*b*3. For example, the leading face 135*b* may be a vertical face parallel to the Z-Z' direction or an arced face recessed in the Y' direction.

When the male connector C2 as received in the connection hole 101 of the female connector C1 is pulled in the Y' direction (removing direction), the edge on the Y-direction side of the lock hole C23 of the male connector C2 presses the lock projection 134*b* of the lock arm 130*b* in the Y' direction to apply thereon a load in the Y' direction. If the leading face 135*b* of the lock arm 130*b* does not include the inclined face 135*b*3, when the lock projection 134*b* is subjected to the above load, at least the lock arm body of the lock arm 130*b* is compressed between the base 120*b* of the female connector C1 and the edge on the Y-direction side of the male connector C2 and thereby elastically deformed. If the leading face 135*b* of the lock arm 130*b* includes the inclined face 135*b*3, when the lock projection 134*b* is subjected to the above load, at least the lock arm body of the lock arm 130*b* is compressed between the base 120*b* of the female connector C1 and the edge on the Y-direction side of the male connector C2 and thereby elastically deformed such that the inclined face 135*b*3 is displaced in the Y' direction. In either case, the load is absorbed by the elastic deformation of the at least lock arm body. Specifically, the load is absorbed to prevent the load from displacing the first free end 131*b*2 of the first arm 131*b* of the lock arm 130*b* in the Z direction and elastically deforming the first arm 131*b* with the base 120*b* as the fulcrum. The absorbed load results in the stable fitting of the lock projection 134*b* of the lock arm 130*b* in the lock hole C23 of the male connector C2. The load may elastically deform the lock arm 130*b* in its entirety, rather than the lock arm body only.

If the second abutment 130*a* of the first body 100*a* includes the first hole 131*a* (chamber), the female connector C1 may further include a seal 200 made of an elastic material, such as silicone rubber. The seal 200 is accommodated in the first hole 131*a* such as to be in close contact, from the side of a direction orthogonal to the Y-Y' direction, with the leading portion C21 of the male connector C2 as received in the connection hole 101. The seal 200 may be of a loop shape, such as an annular shape (see FIGS. 2A to 2E) or a polygonal loop shape. If loop shaped, the seal 200 has an outer size that is substantially equal to or slightly larger than the size of the first hole 131*a*, so that the outer circumferential face of the seal 200 is in close contact with the circumferential wall of the first hole 131*a*. The seal 200 has an inner size that is substantially identical to or slightly smaller than the outer size of the leading portion C21 of the male connector C2. As such, the seal 200 can receive therein the leading portion C21 of the male connector C2, and the inner circumferential face of the seal 200 is in close contact with the outer circumferential face of the leading portion C21 of the received male connector C2 as shown in FIG. 5. The first hole 131*a* may be configured to, rather than accommodate the seal 200, directly hold the leading portion C21 of the male connector C2. In this case, the first hole 131*a* may be so sized as to correspond to the outer size of the leading portion C21 of the male connector C2.

If the female connector C1 includes the seal 200, the main body 110*b* of the second body 100*b* may further include at least one stop abutment 140*b*. The or each stop abutment 140*b* is a projection or ridge on a circumferential wall of the main hole 111*b*, or the end portion on the Y-direction side of the main hole 111*b* (in other words, the edge on the Y-direction side of the main hole 111*b*). The at least one stop abutment 140*b* is located on the Y'-direction side relative to the seal 200, and it abuts the seal 200 or is opposed to the seal 200 with a clearance on the Y'-direction side. The stop abutment 140*b* restricts movement of the seal 200 in the Y' direction. In the embodiment shown in FIGS. 2A to 2E and 4A to 4B, the stop abutment 140*b* is a ridge generally having a U-shaped cross-section in the Z-Z' direction, the ridge extending inwardly of the circumferential wall of the main hole 111*b* from the Y-direction end of the circumferential wall. The seal 200 and the stop abutment 140*b* may be omitted.

The female connector C1 further includes at least one terminal 300. The or each terminal 300 is configured to be accommodated in the connection hole 101 of the body 100 such that a contact portion 310 of the terminal 300 makes contact with a terminal C24 of the male connector C2 as received in the connection hole 101. In the embodiment of FIGS. 1 to 5, the female connector C1 further includes a holder 400 of insulating resin and a shell 500 of metal. The holder 400 holds a plurality of terminals 300, and the shell 500 accommodates and holds the holder 400 and the terminals 300. The first body 100*a* includes a tubular portion communicating with the second hole 132*a*, and the shell 500 is accommodated and held in this tubular portion of the first body 100*a* such that a part of the shell 500 is located in the main hole 111*b* of the second body 100*b* and extends through the seal 200. In other embodiments, the at least one terminal 300 may be directly held in the first body 100*a* to be located in the main hole 111*b* of the second body 100*b*. In such embodiments, the holder 400 and the shell 500 are omitted.

The female connector C1 may further include at least one cable 600 of a corresponding number with the at least one terminal 300. If a single terminal 300 is provided, a single cable 600 is provided and connected to a connection portion 320 of the terminal 300. If a plurality of terminals 300 is provided, a plurality of cables 600 of the same number as the terminals 300 are provided and connected to the respective connection portions 320 of the terminals 300. The at least one cable 600 extends through the tubular portion of the first body 100*a* to be led out of the first body 100*a*. The cables 600 can be bundled into a composite cable as shown in FIGS. 1 to 2E. In this case, the cable 600 is covered with a tubular shield conductor, which is covered with a tubular outer insulator. The cables 600 may be omitted. In this case, the connection portion 320 of the or each terminal 300 may be disposed outside the body 100 to be connected to an electrode of a circuit board (not shown).

A procedure of assembling of the female connector C1 will now be described below in detail. The first body 100*a* is prepared holding the at least one terminal 300 as described above. The second body 100*b* is also prepared. The second body 100*b* is inserted into the first chamber 110*a* of the first body 100*a* from the Z-direction side such as to be accommodated in the first chamber 110*a* (this step will be hereinafter referred to as "the placement step"). In the placement step, the first abutment 120*a* and the second abutment 130*a* of the first body 100*a* are brought into abutment with the second body 100*b* from the Y'- and the Y-direction sides, respectively. The first body 100*a* thus restricts the second body 100*b* positionally in the Y-Y' direction. If the first abutment 120*a* includes the opening 121*a*, the main hole 111*b* of the second body 100*b*, in the placement step, is brought into communication with the opening 121*a*. If the second abutment 130*a* includes the first hole 131*a*, the main hole 111*b* of the second body 100*b*, in the placement step, is brought into communication with the first hole 131*a*. If the female connector C1 includes the seal 200, the seal 200 is inserted from the Y'-direction side into the first hole 131*a* of the first body 100*a* before placing the second body 100*b* into the first chamber 110*a* of the first body 100*a*. In the placement step, the at least one stop abutment 140*b* of the second body 100*b* is located on the Y'-direction side relative to the seal 200, and the main hole 111*b* of the second body 100*b* is brought into communication with the first hole 131*a*. The female connector C1 is thus assembled.

A procedure of connecting the female connector C1 to the male connector C2 will now be described below in detail. The male connector C2 is inserted into the connection hole 101 of the female connector C1. At this point, the edge on the Y-direction side of the lock hole C23 of the male connector C2 presses the lock projection 134*b* of the lock arm 130*b* of the female connector C1 from the Y'-direction side, and the edge pushes the lock arm 130*b* upward, i.e. in the Z direction. The lock arm 130*b* thus pushed elastically deforms in the Z direction with the base 120*b* as the fulcrum. The lock projection 134*b* of the lock arm 130*b* rides up and over the edge on the Y-direction side of the male connector C2 and fits into (is locked into) the lock hole C23. With the male connector C2 received in the connection hole 101, the or each terminal 300 of the female connector C1 is brought into physical contact and electrical connection with a corresponding terminal C24 of the male connector C2. The female connector C1 is thus electrically connected to the male connector C2 to form a connection structure of the female connector C1 and the male connector C2. It is preferable, but not required, that the male connector C2 is received in the connection hole 101 such that the at least part in the Y-Y' direction of the received male connector C2 is held in the connection hole 101 as described above.

A procedure of releasing the connection between the female connector C1 and the male connector C2 will now be described below in detail. A user presses the second free end 133*b*2 (point of effort) of the second arm 133*b* of the lock arm 130*b* toward the connection hole 101, i.e. in the Z'-direction. This press causes the lock arm 130*b* to pivot substantially in the Z direction with the base 120*b* as the fulcrum. More specifically, the above press causes at least the first arm 131*b* of the lock arm 130*b* is elastically deformed with the base 120*b* as the fulcrum, whereby the first free end 131*b*2 of the first arm 131*b* and the lock projection 134*b* (point of application collectively) are displaced substantially in the Z direction. If elastically deformable, the second arm 133*b* elastically deforms in accordance with the elastic deformation of the first arm 131*b* such that the second free end 133*b*2 of the second arm 133*b* is displaced in the Z' direction. Upon displacement in the Z direction of the lock projection 134*b* of the lock arm 130*b*, the lock projection 134*b* is released from the fitting to the lock hole C23 of the male connector C2. At this point, the user pulls out the male connector C2 in the Y' direction (removing direction). This releases the connection between the female connector C1 and the male connector C2.

The female connector C1 and the connection structure provides the following technical features and effects:

1) The female connector C1 is configured such as to eliminate or reduce unintentional release of the fitting (locking) of the lock projection 134*b* of the lock arm 130*b* from the lock hole C23 of the male connector C2 if the male connector C2 is pulled in the Y' direction in the state where the male connector C2 is connected to the female connector C1 (hereinafter referred to as the "connection state"). The reason is as follows. When the male connector C2 is pulled in the Y' direction, load in the Y' direction is exerted on the lock projection 134*b* of the lock arm 130*b*, but the load is absorbed by compressing at least the lock arm body of the lock arm 130*b* between the base 120*b* of the female connector C1 and the edge on the Y-direction side of the male connector C2. In other words, the load hardly acts in such a manner as to displace the first free end 131*b*2 of the first arm 131*b* of the lock arm 130*b* in the Z direction.

2) The female connector C1 has improved tensile strength in the Y' direction for the following reason. The second body 100*b* is fixed in position in the Y-Y' direction by the first and second abutments 120*a*, 130*a* of the first body 100*a*, reducing the possibility that the second body 100*b* becomes detached in the Y' direction from the first body 100*a* even if the male connector C2 in the connection state is pulled in the Y' direction to apply load in the Y' direction to the lock projection 134*b* of the lock arm 130*b*. Also, if the female connector C1 includes the seal 200, the seal 200 in the connection state is in close contact with the outer circumferential face of the leading portion C21 of the male connector C2. When the male connector C2 is pulled in the Y' direction, load in the Y' direction is applied also on the seal 200, and also on the at least one stop abutment 140*b* of the second body 100*b* via the seal 200. The second body 100*b* is received in the first chamber 110*a* of the first body 100*a* from the Z-direction side, and fixed in position in the Y-Y' direction by the first and second abutments 120*a*, 130*a* of the first body 100*a*. The second body 100*b* thus fixed is unlikely to become detached from the first body 100*a* in the Y'-direction due to the load in the Y' direction.

3) The lock arm 130*b* of the female connector C1 has a reduced dimension in the Y-Y' direction, and accordingly the female connector C1 as a whole has a reduced dimension in the Y-Y' direction. This is because the lock arm body of the lock arm 130*b* generally has a lateral U-shape in cross-section.

Second Embodiment

Figure 6:
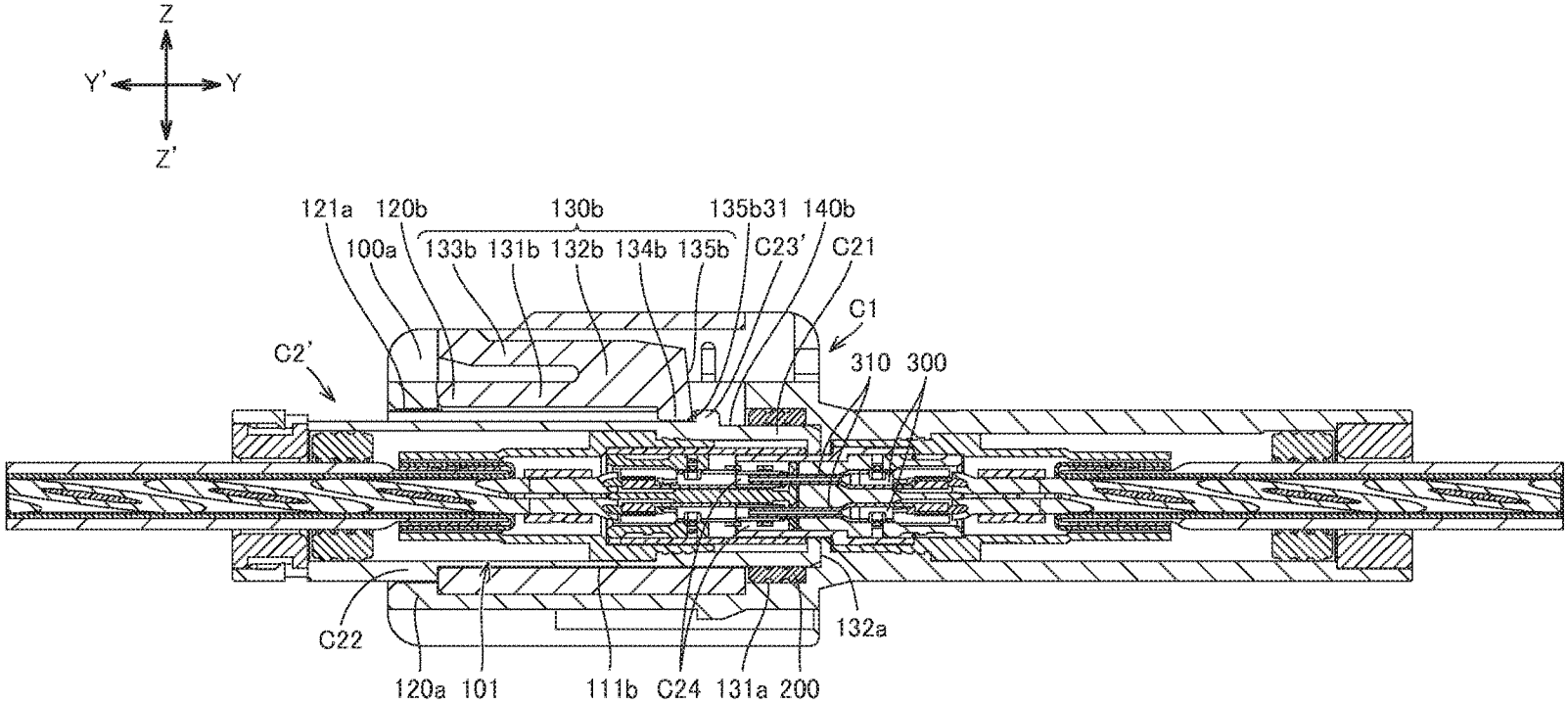
FIG. 6 is a sectional view, corresponding to FIG. 5, of a female connector and a male connector connected thereto according to a second embodiment of the invention.

A connection structure of a female connector C1 and a male connector C2' according to a plurality of embodiments including the second embodiment of the invention will now be described with reference to FIG. 6. FIG. 6 shows the connection structure of the female connector C1 and the male connector C2' according to the second embodiment. In this connection structure, the female connector C1 has the same configuration as the female connector C1 of any of the above aspects, but the male connector C2' has a different configuration from that of the male connector C2. The connection structure of the female connector C1 and the male connector C2' will be described focusing on the differences from the connection structure of the female connector C1 and the male connector C2 and omitting overlapping descriptions. FIG. 6 indicates the Y-Y' and Z-Z' directions in a similar manner to FIG. 5.

The male connector C2' is different from the male connector C2 in that the male connector C2' includes a protrusion C23' instead of the lock hole C23.

In this case, the lock position of the lock projection 134*b* of the lock arm 130*b* of the female connector C1 is a position in the main hole 111*b*, at which the lock projection 134*b* can abut the protrusion C23' of the male connector C2' as received in the connection hole 101 of the female connector C1 from the Y'-direction side. The displacement position of the lock projection 134*b* is on the Z-direction side relative to the lock position. When the lock projection 134*b* as abutting the protrusion C23' of the male connector C2' moves to the displacement position, the lock projection 134*b* becomes disengaged from the protrusion C23'.

If the leading face 135*b* of the lock arm 130*b* has configuration 1) as describe above, the inclined face 135*b*3 of the leading face 135*b* is abuttable on the protrusion C23' of the male connector C2' from the Y'-direction side. If the leading face 135*b* of the lock arm 130*b* has configuration 2) or 3) as describe above, the contact portion 135*b*31 of the inclined face 135*b*3 of the leading face 135*b* is abuttable on the protrusion C23' of the male connector C2' from the Y'-direction side.

When the male connector C2' as received in the connection hole 101 of the female connector C1 is pulled in the Y' direction (removing direction), the protrusion C23' of the male connector C2' presses the lock projection 134*b* of the lock arm 130*b* in the Y' direction to apply thereon a load in the Y' direction. If the leading face 135*b* of the lock arm 130*b* does not include the inclined face 135*b*3, when the lock projection 134*b* is subjected to the above load, at least the lock arm body of the lock arm 130*b* is compressed between the base 120*b* of the female connector C1 and the protrusion C23' of the male connector C2' and thereby elastically deformed. If the leading face 135*b* of the lock arm 130*b* includes the inclined face 135*b*3, when the lock projection 134*b* is subjected to the above load, at least the lock arm body of the lock arm 130*b* is compressed between the base 120*b* of the female connector C1 and the protrusion C23' of the male connector C2' and thereby elastically deformed such that the inclined face 135*b*3 is displaced in the Y' direction. In either case, the load is absorbed by the elastic deformation of the at least lock arm body. Specifically, the load is absorbed to prevent the load from displacing the first free end 131*b*2 of the first arm 131*b* of the lock arm 130*b* in the Z direction and elastically deforming the first arm 131*b* with the base 120*b* as the fulcrum. The absorbed load results in the stable abutment between the lock projection 134*b* of the lock arm 130*b* and the protrusion C23' of the male connector C2'. The load may elastically deform the lock arm 130*b* in its entirety, rather than the lock arm body only.

The female connector C1 can be connected to, and disconnected from, the male connector C2' in a similar manner to the male connector C2.

The connection structure of the female connector C1 and the male connector C2' provides similar technical features and effects to those provided by the connection structure of the female connector C1 and the male connector C2.

Third Embodiment

Figure 7:
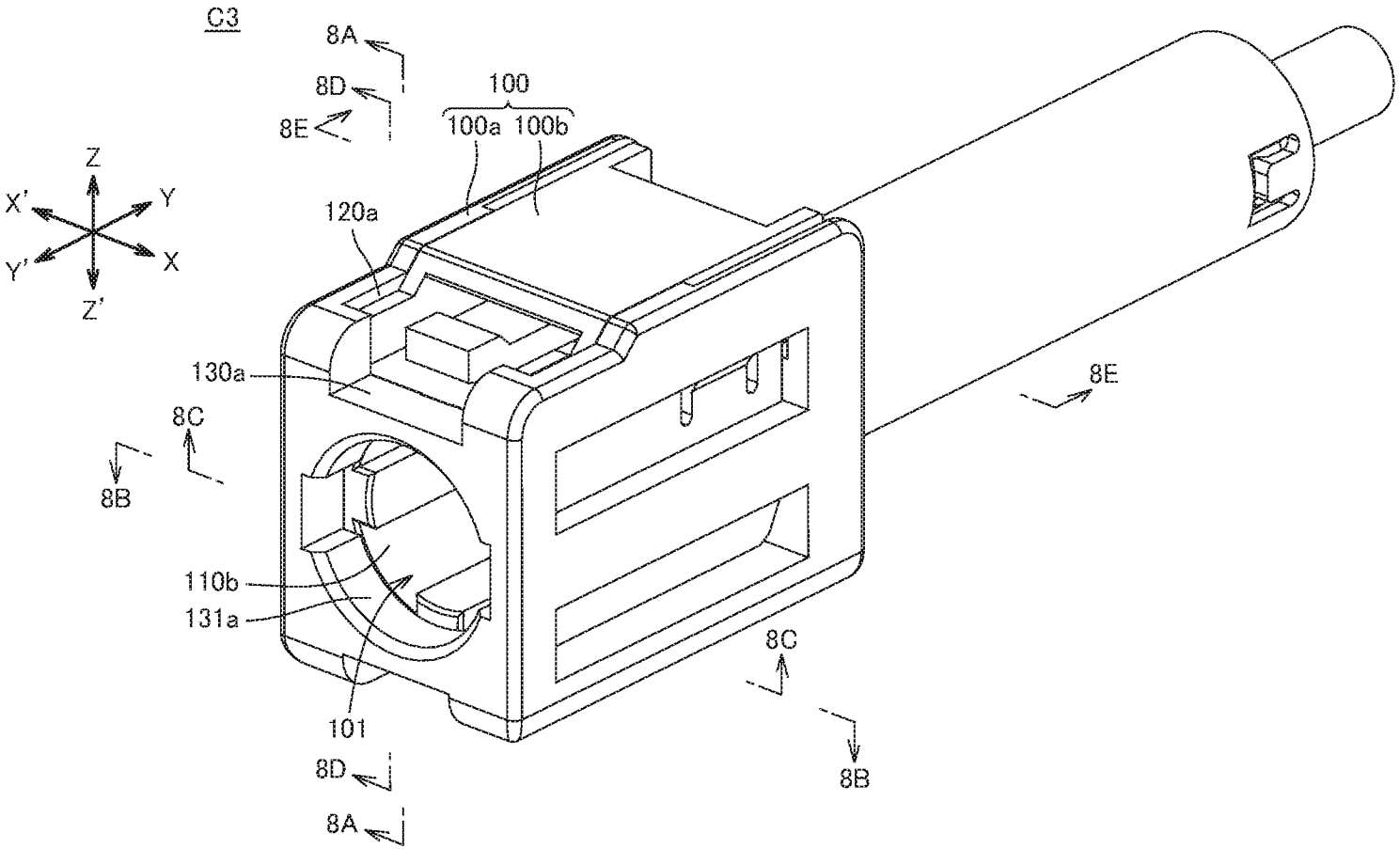
FIG. 7 is a front top right perspective view of a female connector according to a third embodiment of the invention.
Figure 8A:
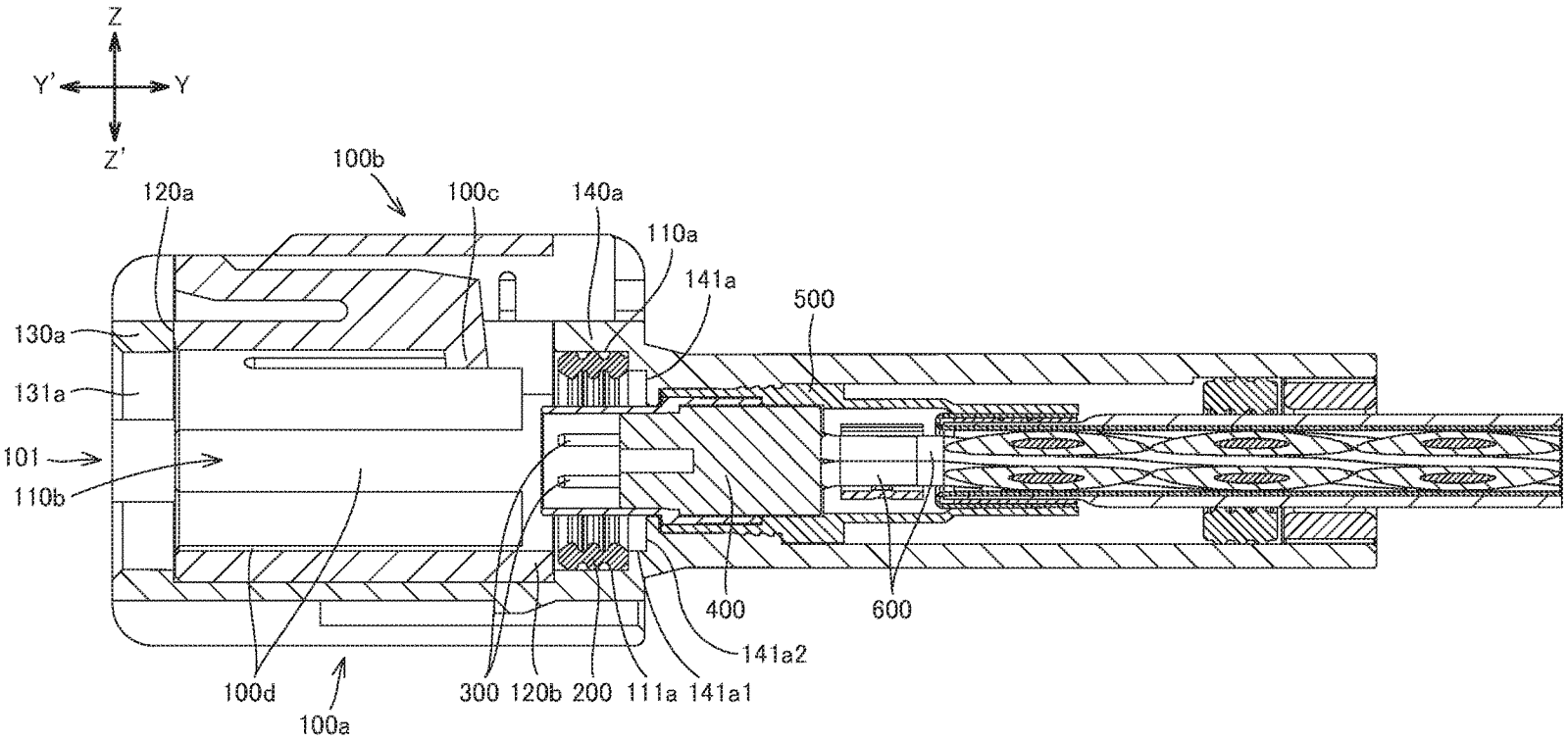
FIG. 8A is a sectional view of the female connector, taken along a line 8A-8A in FIG. 7.
Figure 8B:
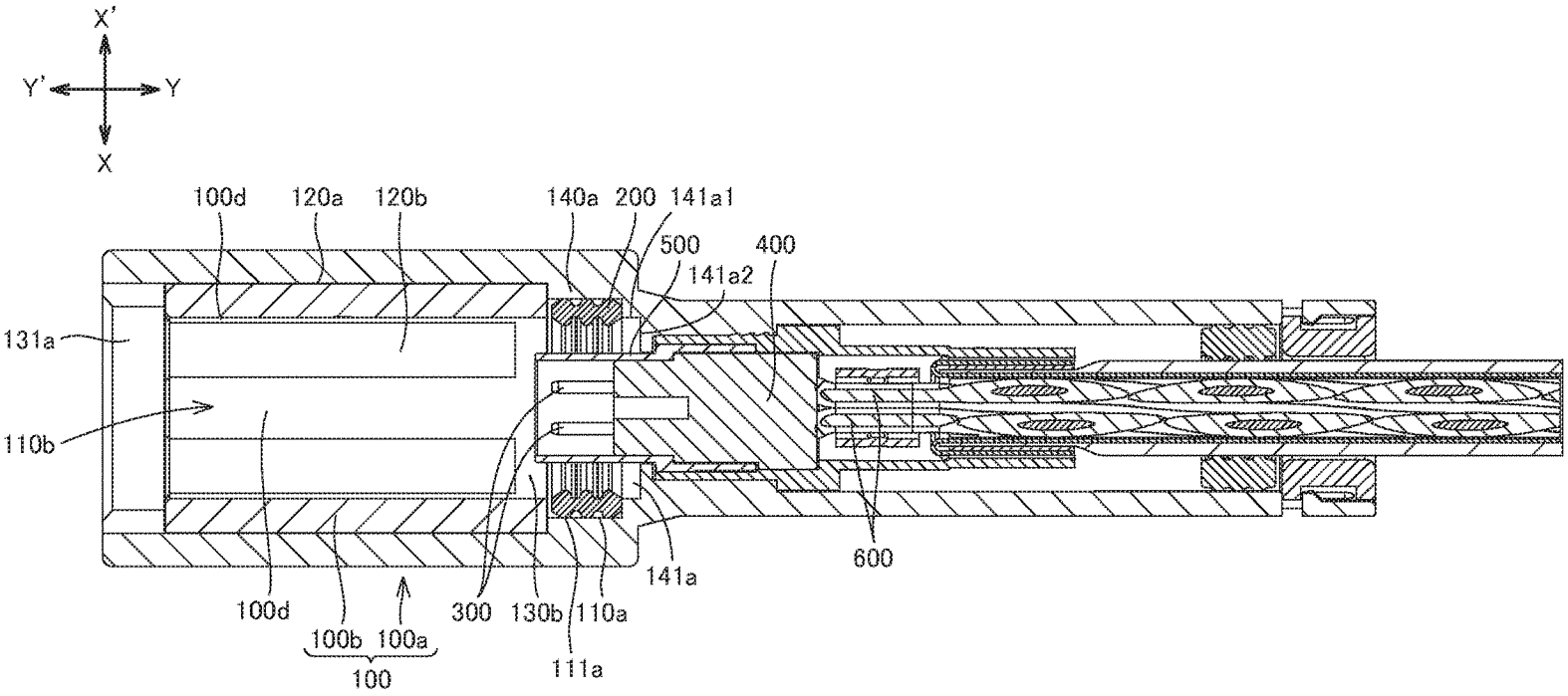
FIG. 8B is a sectional view of the female connector, taken along a line 8B-8B in FIG. 7.
Figure 8C:
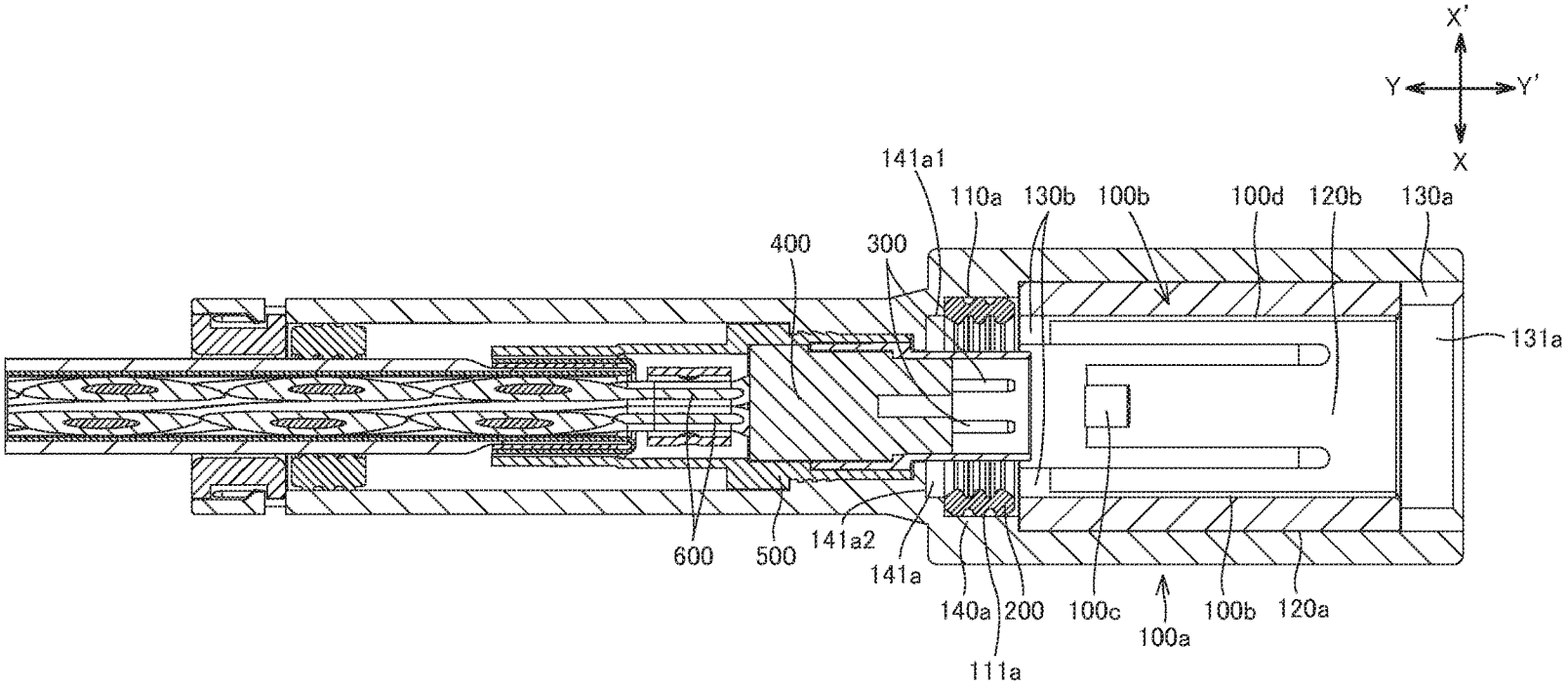
FIG. 8C is a sectional view of the female connector, taken along a line 8C-8C in FIG. 7.
Figure 8D:
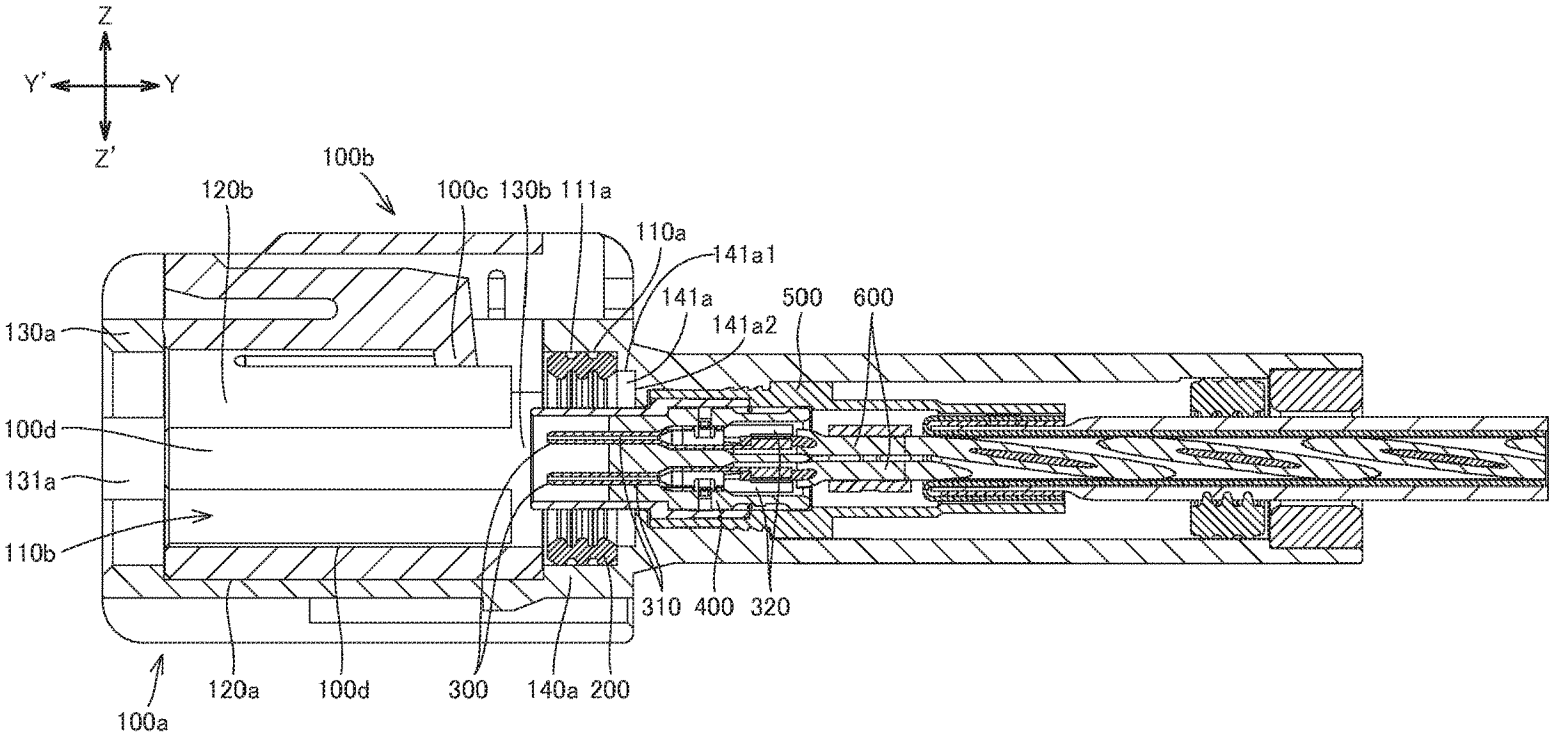
FIG. 8D is a sectional view of the female connector, taken along a line 8D-8D in FIG. 7.
Figure 11:
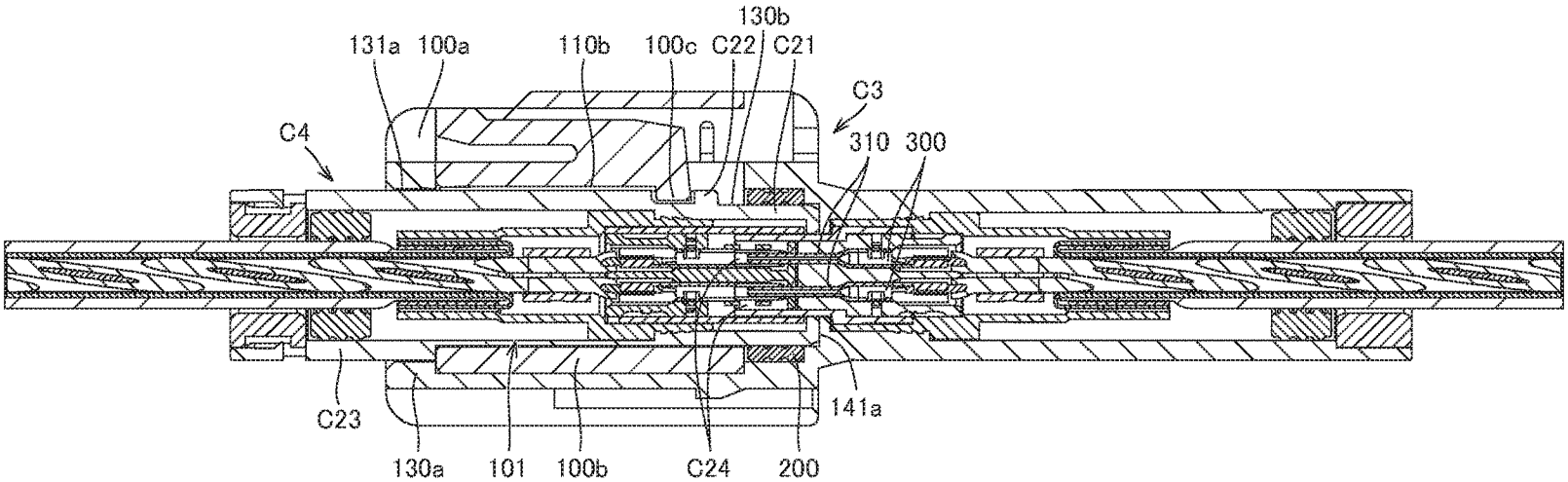
FIG. 11 is a sectional view, corresponding to FIG. 8D, of the female connector and a male connector connected thereto according to the third embodiment of the invention.

A female connector C3 according to a plurality of embodiments including the third embodiment of the invention will now be described with reference to FIGS. 7 to 11. FIGS. 7 to 11 illustrate the female connector C3 according to the third embodiment, and FIG. 11 illustrates the connection structure of the female connector C3 and a male connector C4 of the third embodiment. The Y-Y' direction indicated in FIGS. 7 to 8D is the direction in which the male connector C4 is received in and removed from a connection hole 101 of the female connector C3 (the receiving/removing direction). The Y-Y' direction corresponds to the first direction in the claims. In the Y-Y' direction, the Y direction is the direction in which the male connector C4 is received in the connection hole 101 of the female connector C3 (the receiving direction), and Y' direction is the direction in which the male connector C4 is removed from the connection hole 101 of the female connector C3 (the removing direction). The Y and Y' directions correspond to one side and the other side, respectively, of the first direction. The Z-Z' direction indicated in FIGS. 7 to 8A and 8D to 8E is orthogonal to the Y-Y' direction and corresponds to the second direction in the claims. In the Z-Z' direction, the Z and Z' directions correspond to one side and the other side, respectively, of the second direction. The X-X' direction indicated in FIGS. 7, 8B, 8C and 8E is orthogonal to the Y-Y' and Z-Z' directions.

The female connector C3 includes a body 100 and at least one seal 200. The body 100 includes the connection hole 101 for receiving and removing the male connector C4 in the Y-Y' direction. The body 100 has a first body 100*a* and a second body 100*b*, which are made of an insulating resin.

The first body 100*a* includes a first chamber 110*a*, a second chamber 120*a*, a first abutment 130*a*, and a second abutment 140*a*. The second chamber 120*a* is a space in the first body 100*a*, located on the Y'-direction side relative to the first chamber 110*a*. More specifically, the second chamber 120*a* may be defined by the first abutment 130*a* and the second abutment 140*a*. For example, the second chamber 120*a* may have the same configuration as the first chamber 110*a* of the female connector C1. In this case, the second body 100*b* is received in the second chamber 120*a* from the Z-direction side and fixed in position in the Y-Y' direction by the first body 100*a*.

The first abutment 130*a* and the second abutment 140*a* may have the same configuration as the first abutment 120*a* and the second abutment 130*a*, respectively, of the female connector C1. The first abutment 130*a* is located on the Y'-direction side relative to the second chamber 120*a* and abuts, from the Y'-direction side, the second body 100*b* as accommodated in the second chamber 120*a*. The second abutment 140*a* is located on the Y-direction side relative to the second chamber 120*a* and abuts, from the Y-direction side, the second body 100*b* as accommodated in the second chamber 120*a*.

Figure 8E:
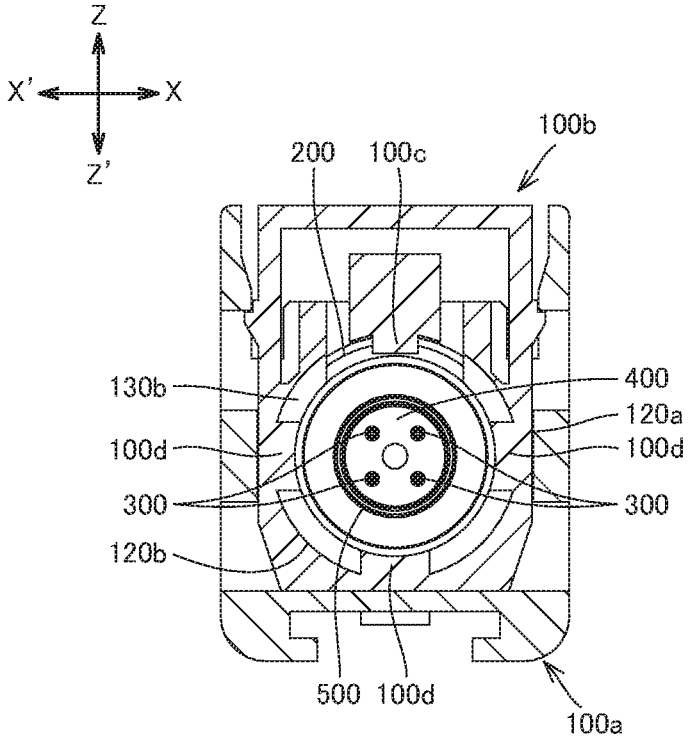
FIG. 8E is a sectional view of the female connector, taken along a line 8E-8E in FIG. 7.
Figure 9:
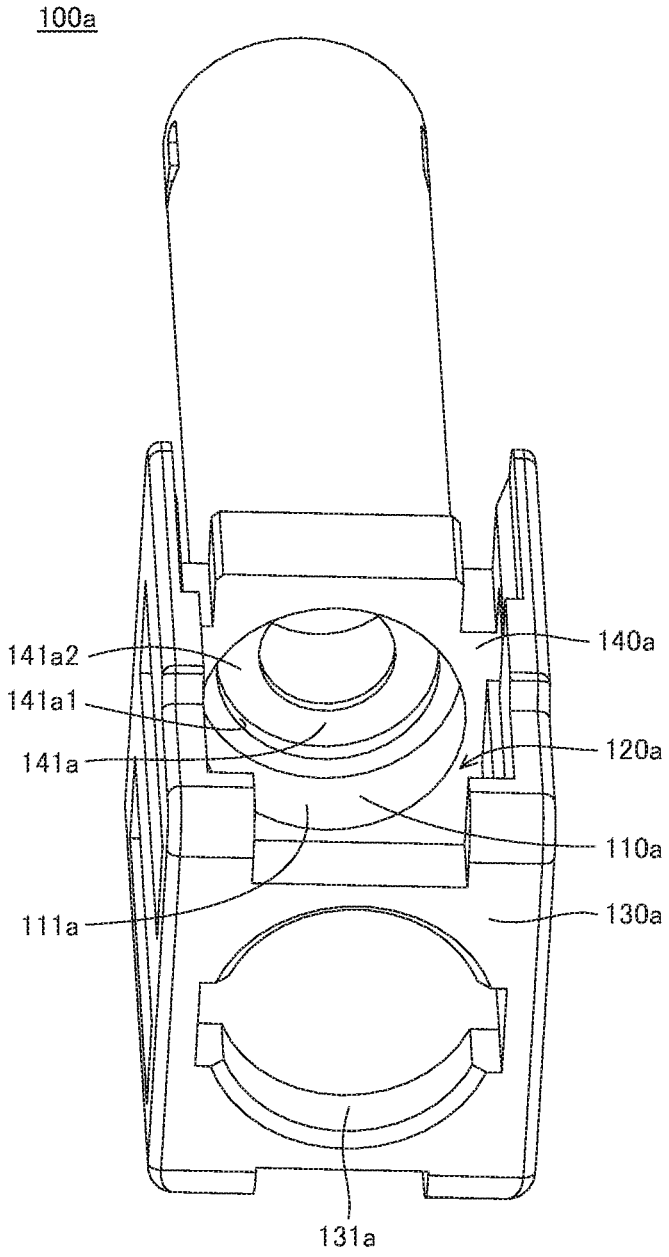
FIG. 9 is a front top left perspective view of the first body of the female connector.
Figure 10A:
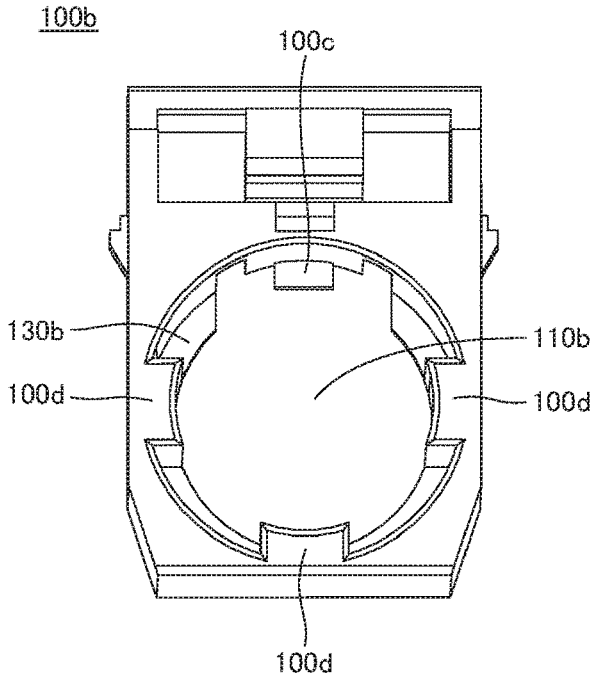
FIG. 10A is a front bottom left perspective view of the second body of the female connector.
Figure 10B:
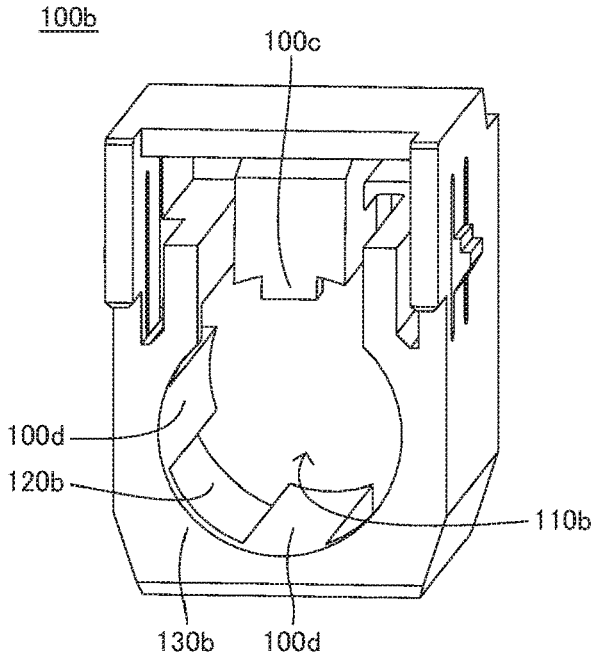
FIG. 10B is a rear top left perspective view of the second body of the female connector.

The first chamber 110*a*, forming part of the connection hole 101, is a hole in of the first body 100*a*. The first chamber 110*a* is located on the Y-direction side relative to the second chamber 120*a* and opens in the Y' direction. If the second abutment 140*a* is a wall, the first chamber 110*a* may, but is not required to, be provided in the second abutment 140*a* as illustrated in FIGS. 8A to 9. As illustrated in FIGS. 8A to 9, the first chamber 110*a* may, but is not required to, communicate directly with the second chamber 120*a*. For example, if a hole is provided between the first chamber 110*a* and the second chamber 120*a* to form part of the connection hole 101, the first chamber 110*a* communicates indirectly with the second chamber 120*a* via such hole. The first chamber 110*a* includes a circumferential wall 111*a* of annular or polygonal loop-shaped.

The at least one seal 200 is made of an elastic material, such as silicone rubber, and accommodated in the first chamber 110*a* such as to be in close contact, from the side of a direction orthogonal to the Y-Y' direction, with the leading portion C21 of the male connector C4 as received in the connection hole 101. The seal 200 may specifically have one of the following configurations 1) and 2), for example:

1) The seal 200 of the female connector C3 may have the same configuration as the seal 200 of the connector C1 (see FIGS. 8A to 8E). The outer circumferential face of the seal 200 is in close contact with the circumferential wall 111*a* of the first chamber 110*a*.

2) The female connector C3 is provided with a plurality of seals 200 in a loop-shaped arrangement and securely accommodated in the first chamber 110*a*. In this case, the outer faces of the seals 200 are in close contact with the circumferential wall 111*a* of the first chamber 110*a*, the leading portion C21 of the male connector C4 can be received inside the space defined by the seals 200 such as to be in close contact with the inner faces of the seals 200.

The second body 100*b* includes a through-hole 110*b* (main hole), a circumferential wall 120*b* of the through-hole 110*b*, and at least one stop abutment 130*b*. The through-hole 110*b* extends in the Y-Y' direction through the second body 100*b*. The through-hole 110 forms part of the connection hole 101. More particularly, when the second body 100*b* is fixed in the second chamber 120*a*, the through-hole 110*b* constitutes a part on the Y'-direction side of the connection hole 101 relative to the first chamber 110*a*. The circumferential wall 120*b* of the through-hole 110*b* is a tubular wall extending in the Y-Y' direction. The or each stop abutment 130*b* is a projection or ridge on the circumferential wall 120*b*, or the end portion on the Y-direction side of the circumferential wall 120*b* (in other words, the edge on the Y-direction side of the through-hole 110*b*). The at least one stop abutment 130*b* is located on the Y'-direction side relative to the at least one seal 200, and it abuts the at least one seal 200 or is opposed to the at least one seal 200 with a clearance on the Y'-direction side. The at least one stop abutment 130*b* restricts movement of the at least one seal 200 in the Y' direction. In the embodiment shown in FIGS. 8A to 8E, 10A, and 10B, a single stop abutment 130*b* is provided as a ridge generally having a U-shaped cross-section in the Z-Z' direction, the ridge extending inwardly of the circumferential wall 120*b* from the Y-direction end of the circumferential wall 120*b*.

If the or each one stop abutment 130*b* is a projection or a ridge, it may be, but is not required to be, abuttable on a step C22 of the male connector C4 from the Y-direction side (see FIG. 11). The at least one stop abutment 130*b* and the circumferential wall 120*b* may, but is not required to, be adapted to hold the step C22 of the male connector C4 inside the through-hole 110*b* of the connection hole 101.

The connection hole 101 includes at least the through-hole 110*b* of the second body 100*b* and the first chamber 110*a* of the first body 100*a*. The through-hole 110*b* and the first chamber 110*a* may directly communicate with each other as illustrated in FIGS. 8A to 8E, or alternatively they communicate with each other indirectly via another hole that forms part of the connection hole 101. If the second abutment 140*a* is a wall, it may be provided with a holding hole 141*a*, which forms part of the connection hole 101. Particularly, the holding hole 141*a* is a part of the connection hole 101 located on the Y-direction side relative to the first chamber 110*a* and in communication with the first chamber 110*a*. In this case, the connection hole 101 at least includes the through-hole 110*b* of the second body 100*b*, the first chamber 110*a* of the first body 100*a*, and the holding hole 141*a*. If the first abutment 130*a* is a wall, it may be provided with an opening 131*a*. The opening 131*a* extends in the Y-Y' direction through the first abutment 130*a* and is located on the Y'-direction side relative to the through-hole 110*b* of the second body 100*b*. In this case, the connection hole 101 at least includes the opening 131*a*, the through-hole 110*b* of the second body 100*b*, and the first chamber 110*a* of the first body 100*a*. The opening 131*a* and the through-hole 110*b* may directly communicate with each other as illustrated in FIGS. 8A to 8E, or alternatively they communicate with each other indirectly via another hole that forms part of the connection hole 101. In the embodiment of FIGS. 8A to 8E, the connection hole 101 includes the opening 131*a*, the through-hole 110*b* of the second body 100*b*, the first chamber 110*a* of the first body 100*a*, and the holding hole 141*a*.

The second abutment 140*a* may, but is not required to, be adapted to hold, on the Y-direction side relative to the second body 100*b*, the leading portion C21 of the male connector C4 as received in the connection hole 101. For example, if the second abutment 140*a* is provided with the holding hole 141 as described above, the holding hole 141*a* may have a circumferential wall 141*a*1 of annular or polygonal loop-shape. The circumferential wall 141*a*1 may conform to the shape of the outer circumferential face of the leading portion C21 of the male connector C4 and accordingly may be abuttable on the outer circumferential face of the leading portion C21. In this case, the leading portion C21 of the male connector C4 is held by bringing the circumferential wall 141*a*1 of the holding hole 141*a* into abutment with the outer circumferential face of the leading portion C21. Also, the holding hole 141*a* may include a wall face 141*a*2 on the Y-direction side, extending orthogonally to the circumferential wall 141*a*1 of the holding hole 141*a*. The wall face 141*a*2 may abut, from the Y-direction side, the leading face (the Y-direction-side the end face) of the leading portion C21 of the male connector C4. In this case, the leading portion C21 of the male connector C4 is held by bringing the circumferential wall 141*a*1 of the holding hole 141*a* into abutment with the outer circumferential face of the leading portion C21 and/or bringing the wall face 141*a*2 of the holding hole 141*a* into abutment with the leading face of the leading portion C21.

The first abutment 130*a* may, but is not required to, be adapted to hold, on the Y'-direction side relative to the second body 100*b*, a portion of the male connector C4 as received in the connection hole 101. This portion of the male connector C4 is located on the Y'-direction side of the leading portion C21 and the step C22 of the male connector C4 and will be hereinafter referred to as a far portion C23. For example, if the first abutment 130*a* is provided with the opening 131*a* as described above, the opening 131*a* may have an inner edge of annular or polygonal loop-shape. This inner edge may conform to the shape of the outer circumferential face of the far portion C23 of the male connector C4 and accordingly may be abuttable on the outer circumferential face of the far portion C23. In this case, the far portion C23 is held by bringing the inner edge of the opening 131*a* of the first abutment 130*a* into abutment with the outer circumferential face of the far portion C23 of the male connector C4. FIG. 11 shows the female connector C3 with the connection hole 101 receiving therein the male connector C4, wherein the second abutment 140*a* holds the leading portion C21 on the Y-direction side relative to the second body 100*b*, while the first abutment 130*a* holds the far portion C23 on the Y'-direction side relative to the second body 100*b*.

The first body 100*a* and/or the second body 100*b* may further include at least one engagement portion 100*c*. The engagement portion 100*c* may have any one of the following configurations 1) to 4).

1) If the first body 100*a* includes the lock arm 130*b* of the female connector C1, an engagement portion 100*c* is provided as a lock projection having the same configuration as the lock projection 134*b* of the lock arm 130*b*. Such lock projection can engage in an engagement recess of the male connector C4 (see FIGS. 7 to 11).

2) An engagement portion 100*c* is provided as an engagement recess in the lock arm, in place of the lock projection of configuration 1) above. Such engagement recess can engage with an engagement projection of the male connector C4.

3) The or each engagement portion 100*c* is an engagement projection on the circumferential wall of a part of the connection hole 101 of the first body 100*a* or on the circumferential wall 120*b* of the through-hole 110*b* of the second body 100*b*. Such engagement recess can engage with an engagement recess of the male connector C4.

4) The or each engagement portion 100*c* is an engagement recess in the circumferential wall of a part of the connection hole 101 of the first body 100*a* or in the circumferential wall 120*b* of the through-hole 110*b* of the second body 100*b*. Such engagement recess can engage with an engagement projection of the male connector C4. In either configuration 3) or 4), the engagement portion 100*c* itself may be made of an elastic body in order to facilitate disconnection of the male connector C4.

The first body 100*a* and/or the second body 100*b* may further include at least one guide 100*d*. The guide 100*d* can have one of the following configurations 1) and 2).

1) The or each guide 100*d* is a guide projection on the circumferential wall of a part of the connection hole 101 of the first body 100*a* or on the circumferential wall 120*b* of the through-hole 110*b* of the second body 100*b*. Such guide projection extends in the Y-Y' direction and can be received in a guide groove of the male connector C4. In the embodiment of FIGS. 7 to 11, a plurality of guides 100*d* is provided, extending in the Y-Y' direction on portions on the Z'-, X-, and X'-direction sides of the circumferential wall 120*b* of the through-hole 110*b* of the second body 100*b*.

2) The or each guide 100*d* is a guide groove in the circumferential wall of a part of the connection hole 101 of the first body 100*a* or in the circumferential wall 120*b* of the through-hole 110*b* of the second body 100*b*. Such guide recess extends in the Y-Y' direction and can receive a guide projection of the male connector C4.

The at least one guide 100*d* of any configuration serves to prevent erroneous insertion of the male connector C4 into the connection hole 101 by guiding the guide groove or the guide projection of the male connector C4. The at least one guide 100*d* may be replaced with a key portion, which may be a projection or a recess, that prevents the erroneous insertion of the male connector C4 into the connection hole 101. The key portion may be provided in the circumferential wall of a part of the connection hole 101 of the first body 100*a* or in the circumferential wall 120*b* of the through-hole 110*b* of the second body 100*b*.

The female connector C3 further includes at least one terminal 300. The or each terminal 300 is configured to be accommodated in the connection hole 101 of the body 100 such that a contact portion 310 of the terminal 300 makes contact with a terminal C24 of the male connector C4 as received in the connection hole 101. In the embodiment of FIGS. 7 to 11, the female connector C3 further includes a holder 400 of insulating resin and a shell 500 of metal. The holder 400 holds a plurality of terminals 300, and the shell 500 accommodates and holds the holder 400 and the terminals 300. The first body 100*a* includes a tubular portion communicating with the holding hole 141*a*, and the shell 500 is accommodated and held in this tubular portion of the first body 100*a* such that a part of the shell 500 is located in the through hole 110*b* of the second body 100*b* and extends through the single seal 200 or through between the seals in a loop-shaped arrangement. The at least one terminal 300 may be directly held in the first body 100*a* and located in the through-hole 110*b* of the second body 100*b*. In this case, the holder 400 and the shell 500 are omitted.

The female connector C3 may further include at least one cable 600 of a corresponding number with the at least one terminal 300. If a single terminal 300 is provided, a single cable 600 is provided and connected to a connection portion 320 of the terminal 300. If a plurality of terminals 300 is provided, a plurality of cables 600 of the same number as the terminals 300 are provided and connected to the respective connection portions 320 of the terminals 300. The cables 600 can be bundled into a composite cable as shown in FIGS. 7 to 8E. In this case, the cable 600 is covered with a tubular shield conductor, which is covered with a tubular outer insulator. The at least one cable 600 extends through the tubular portion of the first body 100*a* to be led out of the first body 100*a*. The cables 600 may be omitted. In this case, the connection portion 320 of the or each terminal 300 may be disposed outside the body 100 to be connected to an electrode of a circuit board (not shown).

A procedure of assembling the female connector C3 will now be described in detail. The first body 100*a* is prepared holding the at least one terminal 300 as described above. The at least one seal 200 is also prepared and inserted into the first chamber 110*a* of the first body 100*a* from the Y'-direction side. The second body 100*b* is also prepared. The second body 100*b* is inserted into the second chamber 120*a* of the first body 100*a* from the Z-direction side such as to be placed in the second chamber 120*a* (this step will be hereinafter referred to as "the placement step"). In the placement step, the first abutment 130*a* and the second abutment 140*a* of the first body 100*a* are brought into abutment with the second body 100*b* from the Y'- and the Y-direction sides, respectively. The second body 100*b* is thus positionally restricted in the Y-Y' direction with respect to the first body 100*a*. In the placement step, the at least one stop abutment 130*b* of the second body 100*b* is located on the Y'-direction side relative to the at least one seal 200, and the through-hole 110*b* of the second body 100*b* is brought into communication directly or indirectly with the first chamber 110*a*. If the first abutment 130*a* includes the opening 131*a*, the through-hole 110*b* of the second body 100*b*, in the placement step, is brought into communication directly or indirectly with the opening 131*a*. The female connector C3 is thus assembled.

The female connector C3 provides the following technical features and effects:

1) The possibility is reduced that the second body 100*b* of the female connector C3 becomes detached in the Y' direction from the first body 100*a* even if the male connector C4 is pulled in the Y' direction. More particularly, when the male connector C4 is pulled in the Y' direction as received in the connection hole 101 of the female connector C3, i.e. in the state where the leading portion C21 of the male connector C4 is received in the at least one seal 200, which is in close contact with the outer circumferential face of the leading portion C21 of the male connector C4 (this state will be hereinafter referred to as a "received state"). At this point, load in the Y' direction is applied to the at least one seal 200 and also to the at least one stop abutment 130*b* of the second body 100*b* via the seal 200. However, the second body 100*b* is received in the second chamber 120*a* of the first body 100*a* from the Z-direction side, and fixed in position in the Y-Y' direction by the first and second abutments 130*a*, 140*a* of the first body 100*a*. The second body 100*b* thus fixed is unlikely to become detached from the first body 100*a* in the Y'-direction due to the load in the Y' direction.

2) It is easy to dispose the at least one stop abutment 130*b* of the second body 100*b* in position with respect to the at least one seal 200 for the following reasons. This is typically the case if the at least one seal 200 is a loop-shaped seal 200 being accommodated in the first chamber 110*a* of the first body 100*a* and having an outer circumferential face in close contact with the circumferential wall 111*a* of the first chamber 110*a*, or a plurality of seals 200 in a loop-shaped arrangement accommodated in the first chamber 110*a* of the first body 100*a* and having respective outer circumferential faces in close contact with the circumferential wall 111*a* of the first chamber 110*a*. The at least one stop abutment 130*b* is a projection or ridge on the circumferential wall 120*b* of the through-hole 110*b* of the second body 100*b*, or the end portion on the Y-direction side of the circumferential wall 120*b*. As such, the at least one stop abutment 130*b* can be easily disposed on the Y'-direction side relative to the at least one seal 200, simply by placing the second body 100*b* into the second chamber 120*a* of the first body 100*a*.

3) When the male connector C4 in the connection state is twisted or pried (moved in a direction crossing the Y-Y' direction), the movement of the male connector C4 causes application of load to the first body 100*a* and the second body 100*b*. However, in the connection state, the second abutment 140*a* and the first abutment 130*a* respectively hold the leading portion C21 and the far portion C23 of the male connector C4 on the Y- and Y'-direction sides relative to the second body 100*b*. Consequently, the applied load is dispersed to the second abutment 140*a* and the first abutment 130*a*, reducing the load applied to the second body 100*b*.

4) If the second body 100*b* of the female connector C3 includes the engagement portion 100*c*, the female connector C3 has improved tensile strength in the Y' direction for the following reason. In the connection state, the engagement portion 100*c* is engaged with the engagement recess or engagement projection of the male connector C4. When the male connector C4 in this state is pulled in the Y' direction, load in the Y' direction is applied to the engagement portion 100*c*. However, the second body 100*b* is fixed in position in the Y-Y' direction by the first and second abutments 130*a*, 140*a* of the first body 100*a* as described above. Therefore, the second body 100*b* with the engagement portion 100*c* is unlikely to move in the Y' direction or become detached in the Y' direction from the first body 100*a*.

5) If the first body 100*a* of the female connector C3 includes the engagement portion 100*c*, load applied to the second body 100*b* is reduced when the male connector C4 in the connection state is pulled in the Y' direction. This is because the engagement portion 100*c* is provided not in the second body 100*b* but in the first body 100*a*, the applied load will not be applied to the second body 100*b* via the engagement portion 100*c*.

6) If the second body 100*b* of the female connector C3 includes the engagement portion 100*c*, the guide 100*d*, and/or the key portion, it is only necessary to replace the second body 100*b* in order to adapt the female connector C3 to engage with and/or guide male connectors of different types, and/or to prevent erroneous insertion of male connectors of different types into the female connector C3. Specifically, it is only necessary to replace the second body 100*b* with a different second body 100*b* having an engagement portion 100*c*, a guide 100*d*, and/or a key portion of different aspect. By adopting a different second body 100*b* having an engagement portion 100*c* of different aspect that is compatible with an engagement recess or projection of a different male connector from the male connector C4, the engagement portion 100*c* of different aspect can be engaged with the engagement recess or projection of the different male connector in the connection state. Likewise, by adopting a different second body 100*b* having a guide 100*d* of different aspect that is compatible with a guide groove or projection of a different male connector from the male connector C4, the guide 100*d* of different aspect can guide the guide groove or projection of the different male connector when inserting the male connector into the female connector. Likewise, by adopting a different second body 100*b* having a key portion of different aspect that is compatible with a key groove or projection of a different male connector, the female connector can receive such different male connector only, preventing erroneous insertion of a male connector of any other type.

The female connectors and the male connectors described above are not limited to the above embodiments, but they may be modified in any manner within the scope of the claims. Some example variants will now be described.

The body of the female connector of the invention may or may not include the first and second bodies as separate components. The first and second bodies of any one of the above aspects may be integrally formed.

In any lock arm of the female connector of the invention, the first free end of the first arm may be provided with a lock hole in place of the lock projection. Such variant female connector may mate with a variant male connector including a lock projection, in place of the lock hole or the protrusion described above. When the variant male connector is received in the connection hole of the variant female connector, the lock projection fits in the lock hole of the lock arm of the variant female connector. The first arm and/or the second arm of any aspect of the invention may be inclined in the Z-Z' direction.

The first abutment of the invention may not be adapted to hold, on the Y'-direction side relative to the second body, the far portion of the male connector as received in the connection hole. For example, if the first abutment is a projection or a lug or provided without an opening, and such first abutment may not be adapted to hold the far portion of the male connector as received in the connection hole. The second abutment of the invention may not be adapted to hold, on the Y-direction side relative to the second body, the leading portion of the male connector as received in the connection hole. For example, if the second abutment is a projection or a lug or provided without a holding hole, the second abutment of the invention may not be adapted to hold the leading portion of the male connector as received in the connection hole. The at least one seal and/or the at least one stop abutment may be omitted in the invention.

It should be appreciated that the above embodiments and variants of female connectors and the male connectors are described above by way of examples only. The materials, shapes, dimensions, numbers, arrangements, and other configurations of the constituents of female connectors and the male connectors may be modified in any manner if they can perform similar functions. The configurations of the embodiments and the variants described above may be combined in any possible manner. The Y-Y' direction (first direction) of the invention may be any direction as long as it is the receiving/removing direction of the male connector with respect to the connection hole of the female connector of the invention. The Z-Z' direction (second direction) of the invention may be any direction crossing the Y-Y' direction. The X-X' direction of the invention may be any direction that crosses the Y-Y' and Z-Z' directions and that is located on a different plane from the plane where the Y-Y' and Z-Z' directions are located.

The present invention can include any combination of these various features or embodiments above and/or below as set-forth in sentences and/or paragraphs. Any combination of disclosed features herein is considered part of the present invention and no limitation is intended with respect to combinable features.

Other embodiments of the present invention will be apparent to those skilled in the art from consideration of the present specification and practice of the present invention disclosed herein. It is intended that the present specification and examples be considered as exemplary only with a true scope and spirit of the invention being indicated by the following claims and equivalents thereof.

REFERENCE SIGNS LIST

C1: female connector
- 100: body
  - 101: connection hole
  - 100a: first body
    - 110a: first chamber
    - 120a: first abutment
      - 121a: opening
    - 130a: second abutment
      - 131a: first hole
      - 132a: second hole
  - 100b: second body
    - 110b: main body
    - 111b: main hole
    - 112b: slot
    - 120b: base
    - 130b: lock arm
      - 131b: first arm
        - 131b1: first fixed end
        - 131b2: first free end
      - 132b: middle portion
      - 133b: second arm
        - 133b1: second fixed end
        - 133b2: second free end
      - 134b: lock projection
      - 135b: leading face
        - 135b1: leading end
        - 135b2: far end
        - 135b3: inclined face
        - 135b31: contact portion
    - 140b: stop abutment
  - 200: seal
  - 300: terminal
    - 310: contact portion
    - 320: connection portion
  - 400: holder
  - 500: shell
  - 600: cable C2, C2': male connector
- C21: leading portion
- C22: far portion
- C23: lock hole
- C23': protrusion
- C24: terminal

What is claimed is:

1. A female connector comprising a body, the body comprising:

a main body, the main body including:

a connection hole for removably receiving a male connector and a slot extending in a receiving direction of the male connector and communicating with the connection hole;

a base located on a removing direction side of the male connector relative to the slot of the main body, the removing direction being opposite to the receiving direction; and a lock arm, the lock arm including:

a first arm extending in the receiving direction from the base inside the slot such as to be adjacent to the connection hole and including a first free end, a middle portion extending from the first free end of the first arm in a direction away from the connection hole, a second arm extending from the middle portion in the removing direction and being spaced from the first arm, and a lock projection extending from the first free end of the first arm toward and into the connection hole, the lock projection being configured to fit in a lock hole of the male connector or abut a protrusion of the male connector from the removing direction side, wherein at least the first arm, the middle portion, and the second arm are configured to be compressed by and between the base and an edge on the receiving direction side of the lock hole of the male connector, or by and between the base and the protrusion of the male connector, when the lock projection is subjected to load in the removing direction from the edge or the protrusion of the male connector.

2. The female connector according to claim 1, wherein the lock arm further includes a leading face on the receiving direction side, the leading face being provided at the lock projection and including:

a leading end being an edge constituted by an end face on the receiving direction side and an end face on the connection hole side of the lock projection, a far end located farther away from the connection hole than the leading end, and an inclined face sloping down in the receiving direction from the far end to the leading end, and at least the first arm, the middle portion, and the second arm are configured to be compressed by and between the base and the edge or protrusion of the male connector such that the inclined face of the lock projection is displaced in the removing direction when the inclined face is subjected to load in the removing direction from the edge or protrusion of the male connector.

3. The female connector according to claim 2, wherein the leading face is provided at the lock projection and the first free end, the far end of the leading face is provided in the first free end, the inclined face of the leading face includes a contact portion, the contact portion being an end face on the receiving direction side of the lock projection, and at least the first arm, the middle portion, and the second arm are configured to be compressed by and between the base and the edge or protrusion of the male connector such that the inclined face is displaced in the removing direction when the contact portion of the lock projection is subjected to load in the removing direction from the edge of the lock hole of the male connector or the protrusion of the male connector.

4. The female connector according to claim 2, wherein the leading face is provided at the lock projection, the first free end, and the middle portion, the far end of the leading face is provided in the middle portion, the inclined face of the leading face includes a contact portion, the contact portion being an end face on the receiving direction side of the lock projection, and at least the first arm, the middle portion, and the second arm are configured to be compressed by and between the base and the edge or protrusion of the male connector such that the inclined face is displaced in the removing direction when the contact portion of the lock projection is subjected to load in the removing direction from the edge of the lock hole of the male connector or the protrusion of the male connector.

5. The female connector according to claim 1, wherein the second arm includes a second free end opposed to and spaced from the first arm or the base, and when the second free end is pressed toward the connection hole, the second arm elastically deforms until the second free end abuts at least one of the first arm and the base, and the first arm elastically deforms with the base as a fulcrum such that the first free end and the lock projection are displaced in a direction away from the connection hole.

6. The female connector according to claim 1, wherein the lock arm comprises a lock arm body generally of a lateral U-shape, and the lock arm body includes the first arm, the middle portion, and the second arm.

7. The female connector according to claim 1, further comprising a seal, wherein the connection hole of the body is configured to removably receive the male connector along a first direction, one side of the first direction is the receiving direction, the other side of the first direction is the removing direction, the body comprises a first body and a second body, the second body including the main body, the first body includes:

a first chamber forming part of the connection hole, the first chamber accommodating the seal such that the seal is in close contact, from a direction orthogonal to the first direction, with the male connector as received in the connection hole, and a second chamber being a space on the other side in the first direction relative to the first chamber of the first body, the second body is received in the second chamber from one side of a second direction and fixed in the first direction by the first body, the second direction crossing the first direction, and the second body includes:

a through-hole forming part of the connection hole and extending through the second body in the first direction, the through-hole being located on the other side in the first direction relative to the first chamber, and a stop abutment located on the other side in the first direction relative to the seal.

8. The female connector according to claim 7, wherein the seal is a loop-shaped body configured to receive therein the male connector, or alternatively the seal comprises a plurality of seals in a loop-shaped arrangement, the seals being accommodated in the first chamber and defining a space to receive therein the male connector, the second body further includes a circumferential wall of the through-hole, and the stop abutment is provided on the circumferential wall of the second body.

9. The female connector according to claim 7, wherein the first body further includes a first abutment located on the other side of the first direction relative to the second chamber, and the first abutment abuts, from the other side in the first direction, the second body accommodated in the second chamber.

10. The female connector according to claim 8, wherein the first body further includes a first abutment located on the other side of the first direction relative to the second chamber, and the first abutment abuts, from the other side in the first direction, the second body accommodated in the second chamber.

11. The female connector according to claim 9, wherein the first body further includes a second abutment located on the one side of the first direction relative to the second chamber, the second abutment abuts, from the one side of the first direction, the second body accommodated in the second chamber, the second abutment is configured to hold, on the one side of the first direction relative to the second body, the male connector as received in the connection hole, and the first abutment is configured to hold, on the other side of the first direction relative to the second body, the male connector as received in the connection hole.

12. The female connector according to claim 10, wherein the first body further includes a second abutment located on the one side of the first direction relative to the second chamber, the second abutment abuts, from the one side of the first direction, the second body accommodated in the second chamber, the second abutment is configured to hold, on the one side of the first direction relative to the second body, the male connector as received in the connection hole, and the first abutment is configured to hold, on the other side of the first direction relative to the second body, the male connector as received in the connection hole.

13. The female connector according to claim 7, wherein the second body includes an engagement portion, the engagement portion being adjacent to the through-hole and engageable with the male connector as received in the connection hole.

14. The female connector according to claim 7, wherein the first body includes an engagement portion, the engagement portion of the first body being engageable with the male connector as received in the connection hole.

15. The female connector according to claim 13, wherein the engagement portion is the lock projection.

16. The female connector according to claim 14, wherein the engagement portion is the lock projection.

17. The female connector according to claim 7, wherein the second body further includes a circumferential wall of the through-hole, the circumferential wall of the through-hole is provided with a guide extending in the first direction, the guide is a guide projection configured to be received in a guide groove of the male connector or a guide groove configured to receive a guide projection of the male connector.

18. A connector connection structure comprising:

the female connector according to claim 1; and a male connector, the male connector including a lock hole or a protrusion, wherein in a state where the male connector is received in the connection hole of the female connector, the lock projection of the female connector fits in the lock hole of the male connector, or alternatively abuts the protrusion of the male connector from the removing direction side, and at least the first arm, the middle portion, and the second arm of the lock arm of the female connector are configured to be compressed by and between the base and the edge on the receiving direction side of the lock hole of the male connector, or by and between the base and the protrusion of the male connector, when the lock projection of the female connector is subjected to load in the removing direction from the edge or the protrusion of the male connector.

* * * * *